US007090725B2

(12) United States Patent
Ikeuchi et al.

(10) Patent No.: US 7,090,725 B2
(45) Date of Patent: Aug. 15, 2006

(54) MOUTHPIECE AND DEVICE AND METHOD FOR APPLYING COATING FLUID

(75) Inventors: Hideki Ikeuchi, Kyoto (JP); Takashi Yoshiyama, Otsu (JP); Yoshihisa Higashida, Nara (JP); Masanori Ueda, Yasu-gun (JP); Yasuki Shimizu, Otsu (JP)

(73) Assignee: Toray Industries, Inc., (JP)

( * ) Notice: Subject to any disclaimer, the term of this patent is extended or adjusted under 35 U.S.C. 154(b) by 142 days.

(21) Appl. No.: 10/451,771

(22) PCT Filed: Dec. 26, 2001

(86) PCT No.: PCT/JP01/11425

§ 371 (c)(1),
(2), (4) Date: Jun. 24, 2003

(87) PCT Pub. No.: WO02/053297

PCT Pub. Date: Jul. 11, 2002

(65) Prior Publication Data

US 2004/0065254 A1 Apr. 8, 2004

(30) Foreign Application Priority Data

Dec. 27, 2000 (JP) ..... 2000-397055
Feb. 22, 2001 (JP) ..... 2001-046556
Sep. 12, 2001 (JP) ..... 2001-276694

(51) Int. Cl.
*B05B 7/00* (2006.01)

(52) U.S. Cl. ..... 118/315; 118/323

(58) Field of Classification Search ..... 118/323, 118/315, 669, 321; 445/60, 24, 58; 427/168, 427/163.3, 162, 165, 256, 286, 287, 64, 68; 425/131.5; 345/60
See application file for complete search history.

(56) References Cited

U.S. PATENT DOCUMENTS 3,655,314 A * 4/1972 Lenk et al. ..... 425/131.5
5,527,178 A * 6/1996 White et al. ..... 425/192 S
5,652,001 A * 7/1997 Perry et al. ..... 425/382.2

* cited by examiner

*Primary Examiner*—Brenda A. Lamb
(74) *Attorney, Agent, or Firm*—DLA Piper Rudnick Gray Cary US LLP

(57) ABSTRACT

A die, having multiple discharge orifices arrayed in a generally straight line for applying an application fluid to an object of application, and an internal application fluid reservoir, wherein braces are provided in the application fluid reservoir and extending in a direction generally orthogonal to the direction of the array of the discharge orifices. Also, an application apparatus and method for application fluid, for relatively moving a base material wherein stripe-shaped vertical barrier ribs are formed on the surface of the base material and horizontal barrier ribs having a height equal to or lower than the vertical barrier ribs are formed in a direction generally orthogonal to the vertical barrier ribs, and a die provided facing the base material, while discharging application fluid from multiple discharge orifices provided on the die, thereby applying application fluid to selected grooves between the vertical barrier ribs of the base material.

9 Claims, 21 Drawing Sheets

Application fluid supplying openings ① and ③ have supplying flow adjustment control valves.

Application fluid supplying openings ① and ③ have supplying flow adjustment control valves.

MOUTHPIECE AND DEVICE AND METHOD FOR APPLYING COATING FLUID

TECHNICAL FIELD

The present invention relates to a die for applying an application fluid, and an application apparatus and method for application fluid, for applying a paste-state application fluid to the surface of a base material using the die. Particularly, the present invention is suitably applied to the manufacturing fields of plasma display panels (hereafter may be referred to as PDP), liquid crystal color filters (hereafter may be referred to as LCM), optical filters, print boards, semiconductors, and so forth, and is particularly suitable for a die for applying an application fluid and an application apparatus and method for application fluid wherein thin-film patterns are formed while discharging an application fluid onto the surface of an object which is the object of application such as a glass substrate or the like without contact, in a PDP manufacturing processing in which high-viscosity application fluid is applied.

BACKGROUND ART

In recent years, displays have come to be widely varied in the principles thereof. One which is currently being given much attention is the plasma display, which enables larger sizes that are thin and with reduced weight, as compared to conventional cathode-ray tubes. With this, electric discharge is generated in a discharge space formed between a front plate and a rear plate, and ultraviolet light primarily around 147 nm is generated from xenon gas due to this discharge, thereby enabling display by the ultraviolet light causing excitation of fluorescent substance. Full-color display can be handled by a driving circuit causing light emission of discharge cells wherein fluorescent substances have been separately applied for red (R), green (G), and blue (B).

Also, with AC type plasma displays regarding which development is recently being actively pursued, a front glass plate having formed thereupon display electrodes/dielectric layer/protective layer, and a rear glass plate having formed thereupon address electrodes/dielectric layer/barrier rib layer/fluorescent substance layer, are applied one to another, and a mixed gas of He-Xe or Ne-Xe is sealed in the discharge space sectioned off by stripe-shaped barrier ribs.

Each of the R, G, and B, fluorescent substance layers have recesses of rough portions formed by barrier ribs extending in one direction for each color, formed on the rear plate, being filled in a stripe-like manner with a fluorescent substance paste having powder-like fluorescent substance particles as the primary component thereof.

Striped black matrix color picture tube panels also have the structure wherein the fluorescent substance is configured in stripes.

Manufacturing such configurations with high productivity and high quality requires technology for separately applying fluorescent substance in constant patterns.

For example, Japanese Unexamined Patent Application Publication No. 10-27543 (U.S. Pat. No. 5,921,836) discloses a method for applying between barrier ribs on a plasma display panel with an application die.

With this die, multiple discharge orifices are bored in a generally straight line with constant spacing therebetween, and an application fluid reservoir is provided within the die.

Also, an application fluid supplying opening for supplying application fluid to the application fluid reservoir is provided at the upper part of the die.

With such a die, the internal pressure of the application fluid reservoir rises upon application fluid being supplied from the application fluid supplying opening, whereby a predetermined amount of application fluid is discharged from the discharge orifices, and application fluid is applied onto the surface of the base material.

However, with a die such as described above, in the event that application fluid is supplied to the application fluid reservoir and the internal pressure of the application fluid reservoir repeatedly rises, there is the risk of the die being pressed open and deformed. Particularly, with dies of a long and narrow shape wherein a great number of discharge orifices are arrayed, the area receiving pressure is great, and accordingly deformation readily occurs. In the event that the die is deformed, there is the possibility that the discharge orifices may also be deformed, causing irregularities in the amount of application fluid discharged and so forth, so there is the risk that application fluid may not be applied to the surface of the base material uniformly. Also, there is another form of the die wherein the member forming the discharge orifices and the member forming the application fluid reservoir are separate members, which are connected by tightening with bolts, by welding, or by adhesion, but in this case, shearing force acts on the connecting face due to the deformation of the die, so there is the possibility that both members peel away, and the die is destroyed. Incidentally, making the components of the die thicker in order to improve pressure-resistant strength within the die contradicts the direction of reduction in weight and reduction in costs of the die and also the application apparatus.

Also, this die has an application fluid reservoir and space above the application fluid within, and a structure is necessary wherein pressurized air is injected to this upper space so as to press the application fluid out from the die by this pressure. The reason is that with a structure wherein application fluid is filled in the die and a constant amount is pumped with a pump or the like, the amount of pressure loss in the piping of the application fluid is great in the event that the viscosity of the fluorescent substance paste which is the application fluid is great, and delay in starting application becomes marked.

Also, with a die having space at the upper part of the application fluid, there is the need to supply the same amount of fluorescent substance paste that has been applied to within the die again, following application of the fluorescent substance paste to the base material which is the object of application.

However, with the application of application fluid such as disclosed in the aforementioned Japanese Unexamined Patent Application Publication No. 10-27543, there are the following problems.

That is, at the time of supplying the fluorescent substance paste to within the die, applying a method wherein the fluorescent substance paste is simply allowed to free-fall from above the die risks bubbles being mixed into the fluorescent substance paste. In the event that bubbles are mixed in, there is a break in the paste discharged at the point that the bubble emerges from the discharge orifice of the die, resulting in faulty application.

Also, at the time of supplying the fluorescent substance paste to within the die, supplying from one place requires too much time. Also, in the event that the fluorescent substance paste has high viscosity, time is required for the fluid level within the die to become flat.

Also, the amount of fluorescent substance paste discharged from the die is determined by the sum of the head of the fluorescent substance paste pooled within the die and the pressure of the pressurized air supplied to the space above the fluorescent substance paste, so there is the need to maintain the fluid level of the fluorescent substance paste constant, in order to maintain the amount of discharge constant.

Particularly, in the event of using a die having multiple discharge orifices, irregularities in the amount of discharge from the discharge orifices occurs unless the fluid level of the fluorescent substance paste is maintained constant and flat, thereby resulting in irregularities in application, and so forth. Accordingly, application fluid is preferably supplied to within the die from multiple application fluid supplying openings.

However, it has been found that supplying application fluid from multiple application fluid supplying openings risks occurrence of application irregularities. According to studies made by the Inventor of the present Application, it has been found that fluorescent substance paste supplied from multiple application fluid supplying openings always merge and pool at a certain position within the die, and that fluorescent substance paste discharged from the discharge orifices near this merging point cause the application irregularities.

That is to say, at the time of supplying fluorescent substance paste to the die, shearing stress such as that which acts while flowing through tubes and the like acts upon the fluorescent substance paste. High-viscosity paste such as the fluorescent substance paste is subject to change in viscosity due to the magnitude and time of the shearing stress. Part of the fluorescent substance paste supplied into the die having been subjected to shearing always reaches the merging position and pools.

The fluorescent substance paste at the merging point differs from the fluorescent substance paste at other parts with regard to the magnitude of the shearing stress and the time of acting thereof, and accordingly, the viscosity is markedly changed as to fluorescent substance paste at other parts. At the time of pressurizing the fluorescent substance paste for discharging from the discharge orifices, there is a correlation between the amount of discharge and the paste viscosity under the same pressure, and consequently, the amount of fluorescent substance paste discharged from the discharge orifices near the merging position differs from that at other parts, thus causing faulty application such as irregularities in application.

Also, in the field of plasma displays in recent years, in order to answer the demand for improved brightness and contrast and conservation in electric power consumed, a base material 100 is being employed wherein horizontal barrier ribs 102 which generally orthogonally intersect vertical barrier ribs 101 extending in the direction of application of application fluid as shown in FIG. 1 (in the direction of the arrows in FIG. 1) and which are lower than the vertical barrier ribs 101, are formed (e.g., Japanese Unexamined Patent Application Publication No. 11-213896, Japanese Unexamined Patent Application Publication No. 2000-123747, etc.). With such a base material 100, horizontal barrier ribs 102 are disposed between the vertical barrier ribs 101, so the grooves 110 of the barrier ribs 101 are formed with a lattice-like shape, having recesses 103 and 104.

Also, with the above-described application method for application fluid, the application fluid 108 containing fluorescent substance is applied to the grooves 110 and then dried and hardened to form the fluorescent substance layer, but with light-emitting substrates for plasma displays, the discharge generated between the barrier ribs 101 must be allowed to efficiently act and the light emitted at the fluorescent substance must be efficiently extracted in order to perform suitable light emission between the barrier ribs 101. As a form of the fluorescent substance layer to that end, the fluorescent substance layer preferably exists over a wide range on the entire face of the wall faces of the barrier ribs 101 and the base of the grooves. Accordingly, the application fluid 108 is preferably applied so as to fill up the grooves 110.

However, using the application apparatus and the method thereof for applying application fluid to conventional base material having striped grooves, for applying application fluid to base material having lattice-shaped grooves, without any change, risks the following problems. That is to say, as shown in FIG. 2, in the event of applying the paste-state application fluid to the grooves 110 formed between each of the vertical barrier ribs, the application fluid discharged from the discharge orifice 106 of the die 105 must cross over the horizontal barrier rib 102, but the clearance between the apex of the horizontal barrier rib 102 and the face 109 of the discharge orifice formation plate 107 which has the discharge orifice 106 of the die 105 becomes small, so there is the risk of the application fluid (paste) 108 coming into contact of the face 109 of the discharge orifice formation plate 107, as indicated by the dotted line in FIG. 2. Once the application fluid becomes adhered near the discharge orifice 106 of the discharge orifice formation plate 107 during application, the application fluid discharged from the discharge orifice 106 is drawn to that point, so discharging actions are disturbed, and there is the risk of skipped application portions wherein the application fluid is not applied to the groove 110, which are so-called isolated spots.

Accordingly, it is an object of the present invention to provide a die with improved pressure-resistance while dealing with requests for reduced weight and reduced costs, and to provide an application apparatus and application method for application fluid and a manufacturing apparatus and manufacturing method for a base material for a plasma display, wherein application fluid can be uniformly applied to the surface of the base material by employing this die.

Also, in light of the various problems as described above, it is an object thereof to provide a die wherein application fluid is discharged from multiple discharge orifices and no discharge irregularities occur thereby, and an application apparatus and application method using the die, and particularly an application apparatus and application method enabling application in a desired uniform manner at the time of applying fluorescent substance paste of a high viscosity from the application die to multiple recesses of a base material wherein a constant uneven pattern is formed such as with barrier ribs of plasma display panels.

Also, it is an object thereof to provide an application apparatus and application method for application fluid and a manufacturing apparatus and manufacturing method for a base material for a plasma display panel, wherein application skipping (isolated spots) is prevented even upon application of application fluid to the base material with lattice-like grooves formed on the surface thereof, so as to allow desired paste patterns to be drawn and formed on the surface of the base material in a sure manner.

DISCLOSURE OF INVENTION

In order to solve the above problems, a die according to the present invention has a plurality of discharge orifices arrayed in a generally straight line for applying an application fluid to an object of application, and an internal application fluid reservoir, wherein a brace is provided in the application fluid reservoir and extending in a direction generally orthogonal to the direction of the array of the discharge orifices.

The die may comprise a discharge orifice forming member whereby discharge orifices are formed, and an application fluid reservoir forming member whereby the application fluid reservoir is formed, the members being mutually connected, and a lid member for closing off the top of the part members of the application fluid reservoir.

A plurality of the braces are preferably arrayed in a direction following the array direction of the discharge orifices, at equal intervals. Arranging braces thus uniformly improves pressure-resistance strength of the die in the direction following the direction of array of the discharge orifices. Note that the braces may be integrally formed with the application fluid reservoir forming member.

While the die according to the present invention may be applied to a wide range of technical fields, this is particularly optimally used with an application apparatus for applying application fluid to a base material, comprising: a table for fixing base material; a die provided facing the base material, for applying a predetermined amount of application fluid to the base material; and moving means for relatively moving the table and die 3-dimensionally.

Particularly, this is optimally used with an application apparatus wherein dimensions in the direction perpendicular to the relative movement direction of the die need to be longer than the application region of application fluid on the base material.

In order to solve the above problems, an application method for application fluid according to the present invention comprises a method for relatively moving a base material and a die having a plurality of discharge orifices provided facing the base material and arrayed in a generally straight line, while discharging application fluid from discharge orifices so as to apply application fluid on the base material, and performing application using a die provided with a brace extended in a direction orthogonal to the direction of array of discharge orifices at an application fluid reservoir formed within the die.

For the base material, a light-emitting substrate for plasma display wherein a plurality of stripe-like recesses or lattice-like recesses are formed on the surface, and wherein paste containing a fluorescent substance for one color of red, blue, and green, is applied to the recesses, can be given.

With such a die, braces extending in a direction orthogonal to the direction of array of the discharge orifices are provided at the application fluid reservoir, so strength can be improved with regard to force pressing open the application fluid reservoir forming members from the inside. Accordingly, pressure-resistant strength with regard to the inner pressure of the die can be greatly improved while dealing with the request of reduction in weight and reduction in costs, and deformation of the die and so forth can be prevented in a sure manner. Also, providing a plurality of braces at equal intervals in the direction following the direction of array of the discharge orifices allows the pressure-resistant strength of the die with regard to inner pressure to be improved uniformly in the longitudinal direction of the die. Thus, according to the application apparatus and application method for application fluid employing the die, deformation of the die and so forth can be prevented in a sure manner, so the application fluid can be applied to the surface of the base material in a uniform manner.

Also, the die according to the present invention comprises: an application fluid reservoir for storing application fluid; a plurality of discharge orifices externally opening from the inner side of the application fluid reservoir; and a plurality of application fluid supplying openings for supplying application fluid to the application fluid reservoir; wherein each of the application fluid supplying openings are connected to a tournament-ladder-shaped channel for branching the flow of application fluid from an application fluid supply source upstream and supplying to each of the application fluid supplying openings. That is to say, the application fluid passes through a tournament-ladder-shaped channel from the application fluid supply source to the application fluid supplying openings at the time of supplying application fluid to within the application fluid reservoir of the die, in order to match the amount of supply flow at the multiple application fluid supplying openings.

Also, preferably, the tips of the application fluid supplying openings are formed in the shape of pipes, and the tips thereof are provided so as to be immersed in the application fluid within the application fluid reservoir. That is to say, the structure involves the supply openings being formed in the shape of pipes and tips thereof being immersed in the application fluid, so that particularly there is no mixing in of air bubbles at the time of supplying the application fluid.

Also, the spacing between adjacent application fluid supplying orifices are preferably all equal. That is to say, with the supply flow from the application fluid supplying openings being the same, and taking into consideration the flatness of the application fluid level, the spacing between adjacent application fluid supplying orifices are all preferably equal.

Also, the tournament-ladder-shaped channel may be configured of pipes, or may be configured by applying plates with grooves formed thereupon, one to another. Particularly, with the latter configuration, the plates applied one to another can be removed and inside of the channels can be cleansed, so the cleansability thereof is excellent.

Also, a supply flow adjustment control valve for performing adjustment control of the flow of application fluid supplied may be provided upstream from the application fluid supplying openings. Also, a configuration may be employed wherein flow adjustment control valves are provided upstream of at least one application fluid supplying opening of adjacent application fluid supplying openings. This supply flow adjustment control valve is a valve which may simply serve to open and close a valve, or to have diaphragm components to change the supply flow over time for one opening, or to cyclically change the supply flow each time there is an opportunity to supply, without changing the supply flow in one opening. According to such an configuration, the position where the application fluid supplied from the application fluid supplying openings merges within the application fluid reservoir can be oscillated (moved). That is to say, the position of merging can be moved as long as there is change (at each time of supply, or over time) in the adjustment control valve for the supply flow from each of the application fluid supplying openings. Also, the position of merging can be moved as long as there is change in the application fluid supply flow of at least one of adjacent application fluid supplying openings. Thus, application fluid which is pooling or which would pool at the merging position can be oscillated, so there is no marked change in the viscosity of the application fluid, and no application irregularities occur.

Also, the position of merging can be moved with a different form from that described above. For example, a structure may be employed wherein the plurality of application fluid openings are divided into two groups, and wherein a tournament-ladder-shaped channel is formed for each group. That is to say, the flow supplied from the application fluid supplying openings in the same group are matched by each of the tournament-ladder-shaped channels. Now, let us say that four application fluid supplying openings are linearly disposed, and that the supply openings are arrayed in the order of ①, ②, ③, ④. These are divided into two groups of ① and ②, and ③ and ④, each of the groups forming tournament-ladder-shaped channels. Accordingly, supply may be made to four places simultaneously, or to ① and ②, alone, or ③ and ④ alone. In the event that supply is made to ① and ②, and ③ and ④ simultaneously, places where the application fluid merges (interfaces) occur between each application fluid supplying opening, and the application fluid discharged therefrom causes application irregularities. Accordingly, first supplying from ① and ② alone in order to move (blur) the place of merging causes a merging place to occur between ① and ②, but there is no supply from ③ and ④, so the application fluid flows toward ③ and ④ over time, and the interface where ① and ② merge also moves and is blurred. This does away with application irregularities. However, in the event that supply is made from ① and ② alone indefinitely, the application fluid does not readily flow if the viscosity thereof is high, so the application fluid at the ③ and ④ side may run out, or the fluid level may greatly differ between the ① and ② side and the ③ and ④ side, whereby faulty application occurs. Accordingly, to prevent this, the supply is then switched to being made from ③ and ④. That is, in the event that supply from ① and ② alone and ③ and ④ alone is continued a certain number of times or alternately, the merging position moves each time, and application irregularities do not occur. Note that while the multiple application fluid supplying orifices have been described as being divided into two groups, but any arrangement of two or more groups may used, and the same advantages can be obtained.

Or, a configuration may be made wherein four or more of the application fluid supplying openings are provided, and wherein linearly disposed application fluid supplying openings are alternately divided into two groups, with a tournament-ladder-shaped channel being formed for each group. That is to say, in the same manner as that described above, in the event that there are four application fluid supplying orifices, ① and ③, and ② and ④ are grouped and connected by tournament-ladder-shaped channels. Accordingly, four places may be supplied simultaneously, or supply may be made from ① and ③ alone, or ② and ④ alone. In the event that the spacing between ①, ②, ③, and ④ is the same, first, in the event that supply is made from ① and ③ alone, the application fluid merges at the position of ②. In the same way, in the event that supply is made from ② and ④ alone, the application fluid merges at the position of ③. That is to say, supplying from one group (① and ③) causes application irregularities to occur at the merging position therebetween (②), but in the event that supply is made from the other group (② and ④), the merging position which occurred earlier is forcibly perturbed (moved), so no application irregularities occur. As with the earlier description, continuing supplying from ① and ③ alone and ② and ④ alone a certain number of times or alternately, is sufficient. Also, this configuration is advantageous with regard to flattening the fluid level, as compared to the above-described configuration. While the spacing between ①, ②, ③, and ④ has been made the same to facilitate description, the present invention is not restricted to this. Directly supplying at a later time to a position where merging occurs at a prior time can forcibly perturb, but the merging position can be sufficiently moved near the position of merging, as well. Also, supply flow adjustment control valves for performing adjustment control of the supply flow of the application fluid may be provided upstream of each of the tournament-ladder-shaped channels of the two groups. The supply flow adjustment control valve is a valve which may simply serve to open and close a valve, or to have diaphragm components to change the supply flow over time for one opening. According to such an configuration, supplying from each group or stopping thereof can be easily performed.

Also, the die according to the present invention may be configured with the plurality of discharge orifices linearly disposed, and the plurality of application fluid supply orifices linearly arrayed in a generally parallel manner with the array direction of the discharge orifices.

An application apparatus for application fluid according to the present invention comprises: a table for fixing base material; a die provided facing the base material, for applying a predetermined amount of application fluid to the base material; moving means for relatively moving the table and die 3-dimensionally; and an application fluid tank which is the supply source of application fluid to the die; and further comprising a supply flow adjustment control valve for performing adjustment control of the flow of application fluid supplied, provided between the application fluid tank and die; and control means for controlling flow of the supply flow adjustment control valve; using the die described above for the die thereof.

Such an application apparatus for application fluid may further comprise detecting means for detecting the amount of application fluid within the application fluid reservoir of the die, wherein application fluid is supplied from the application fluid tank to the die by controlling the supply flow adjustment control valve of the application fluid between the application fluid tank and the die according to the detection results of the application fluid amount. An example of means for detecting the application fluid amount within the application fluid reservoir is using a sensor for detecting the application fluid level height.

Such an application apparatus for application fluid is particularly advantageous for manufacturing plasma display panel base material. That is to say, with the manufacturing apparatus for plasma display panel base material according to the present invention, the base material is a plasma display panel light-emitting base material, and wherein the application fluid is paste containing a fluorescent substance powder for emitting light of one color of red, green, or blue, and wherein the application apparatus employed is an application apparatus such as described above.

The application method for application fluid according to the present invention is a method for applying application fluid to a base material, by supplying application fluid from an application fluid supply source to a die having a plurality of discharge orifices, relatively moving the die and base material with the die facing the base material, discharging application fluid from the discharge orifices of the die, and applying application fluid to the base material, wherein the die has a plurality of application fluid supplying openings, with application fluid being supplied in such a manner that the position wherein the application fluid supplied from each of the application fluid supplying openings merges within the application fluid reservoir does not remain at a certain fixed position, so as to apply the application fluid.

With this method, the flow of application fluid supplied from each application fluid supplying opening of the plurality of application fluid supplying openings may be changed over time, so that the position wherein the application fluid supplied from each of the application fluid supplying openings merges within the application fluid reservoir does not remain at a certain fixed position. Also, the flow of application fluid supplied from each application fluid supplying opening may changed each time supplying is performed in the course of repeating application of application fluid to the base material and supplying of application fluid to within the application fluid reservoir of the die, so that the position wherein the application fluid supplied from each of the application fluid supplying openings merges within the application fluid reservoir does not remain at a certain fixed position.

Also, the application method for application fluid according to the present invention is a method for supplying application fluid from an application fluid supply source to a die having a plurality of discharge orifices, relatively moving the die and base material with the die facing the base material, discharging application fluid from the discharge orifices of the die, and applying application fluid to the base material, wherein application fluid is applied using the die described above for the die.

With this method, the flow of application fluid supplied from each application fluid supplying opening may changed each time supplying is performed in the course of repeating application of application fluid to the base material and supplying of application fluid to within the application fluid reservoir of the die. Also, in the event that the multiple application fluid supplying openings are divided into two groups, the supply of application fluid from the application fluid supplying openings of each group may be alternately switched each time supplying is performed in the course of repeating application of application fluid to the base material and supplying of application fluid to within the application fluid reservoir of the die. At this time, supplying of application fluid from the application fluid supplying openings of each group may be continued two times or more, following which the supplying action is alternately repeated with each of the groups. Also, supply of application fluid from the application fluid supplying openings of one group, supply of application fluid from the application fluid supplying openings of the other group, and supply of application fluid from the application fluid supplying openings of both groups, may be repeated with a constant number of times and cycle.

With such an application method for application fluid, the amount of application fluid within the application fluid reservoir of the die may be detected, and application fluid may be supplied to the die based on the detection results. The manufacturing method for plasma display panel base material according to the present invention is a method wherein the base material is a plasma display panel light-emitting base material, wherein the application fluid is paste containing a fluorescent substance powder for emitting light of one color of red, green, or blue, and the method comprises a step for applying application fluid using an above-described application method.

The plasma display panel according to the present invention uses the plasma display panel base material manufactured by the method described above.

Also, the application method for application fluid according to the present invention is a method for relatively moving a base material wherein stripe-shaped vertical barrier ribs are formed on the surface of the base material and horizontal barrier ribs having a height equal to or lower than the vertical barrier ribs are formed in a direction generally orthogonal to the vertical barrier ribs and a die provided facing the base material, while discharging application fluid from a plurality of discharge orifices provided on the die, thereby applying application fluid to selected grooves between the vertical barrier ribs of the base material, wherein a diameter (D) of the discharge orifices of the die, the height (Hh) of the horizontal barrier ribs, and the spacing (C) between a face having the discharge orifices of the die and a bottom face of grooves formed by being encompassed by the vertical barrier ribs and horizontal barrier ribs of the base material, satisfy the conditions of $D+Hh<C$.

Also, in the event that the discharge orifices of the die are formed with a non-circular shape, it is sufficient that the opening dimensions (B) of the discharge orifices following the direction of application of the application fluid satisfy the conditions of $B+Hh<C$.

Also, in order to solve the above problems, another application method for application fluid according to the present invention relatively moves a base material wherein stripe-shaped vertical barrier ribs are formed on the surface of the base material and a die provided facing the base material, while discharging application fluid from a plurality of discharge orifices provided on the die, thereby applying application fluid to selected grooves between the vertical barrier ribs of the base material, wherein the relative velocity (V) between the base material and die and the discharge velocity (v) of the application fluid from the discharge orifices of the die satisfy the conditions of $0<V/v\leqq 1$. Note that the horizontal barrier ribs having a height equal to or lower than the vertical barrier ribs may be formed on the base material in a direction generally orthogonal to the vertical barrier ribs.

Also, in order to solve the above problems, another application method for application fluid according to the present invention relatively moves a base material wherein stripe-shaped vertical barrier ribs are formed on the surface of the base material and a die provided facing the base material, while discharging application fluid from a plurality of discharge orifices provided on the die, thereby applying application fluid to selected grooves between the vertical barrier ribs of the base material, wherein the area (a) of discharge orifices of the die and the cross-sectional area (A) of grooves formed between the vertical barrier ribs satisfy the conditions of $0<a/A\leqq 1$.

In order to solve the above problems, another application method for application fluid according to the present invention relatively moves a base material wherein stripe-shaped vertical barrier ribs are formed on the surface of the base material and horizontal barrier ribs having a height equal to or lower than the vertical barrier ribs are formed in a direction generally orthogonal to the vertical barrier ribs and a die provided facing the base material, while discharging application fluid from a plurality of discharge orifices provided on the die, thereby applying application fluid to selected grooves between the vertical barrier ribs of the base material, wherein the area (a) of discharge orifices of the die, cross-sectional area (A) of grooves formed between the vertical barrier ribs and horizontal barrier ribs, the height (H) of the vertical barrier ribs, the length (L) of the application direction between horizontal barrier ribs, the height (Hh) of the horizontal barrier ribs, the length (Lh) of the application direction of one horizontal barrier rib, and the ratio (k) of application amount between a substrate with horizontal barrier ribs and a substrate with no horizontal barrier ribs, satisfy the following conditions (1) and (2).

$$K=1-(Hh/H)\cdot(Lh/(L+Lh)) \quad (1)$$

$$0<a/(k\cdot A)\leqq 1 \quad (2)$$

In order to solve the above problems, another application apparatus for application fluid according to the present invention relatively moves a base material wherein stripe-shaped vertical barrier ribs are formed on the surface of the base material and horizontal barrier ribs having a height equal to or lower than the vertical barrier ribs are formed in a direction generally orthogonal to the vertical barrier ribs and a die provided facing the base material, while discharging application fluid from a plurality of discharge orifices provided on the die, thereby applying application fluid to selected grooves between the vertical barrier ribs of the base material, wherein a diameter (D) of the discharge orifices of the die and the spacing (C) between a face having the discharge orifices of the die and a bottom face of grooves formed by being encompassed by the vertical barrier ribs and horizontal barrier ribs of the base material are stipulated such that the diameter (D), the height (Hh) of the horizontal barrier ribs, and the spacing (C), satisfy the conditions of D+Hh<C.

Also, in order to solve the above problems, another application apparatus for application fluid according to the present invention relatively moves a base material wherein stripe-shaped vertical barrier ribs are formed on the surface of the base material and a die provided facing the base material, while discharging application fluid from a plurality of discharge orifices provided on the die, thereby applying application fluid to selected grooves between the vertical barrier ribs of the base material, wherein the area (a) of discharge orifices of the die is stipulated such that the area (a) and the cross-sectional area (A) of grooves formed between the vertical barrier ribs satisfy the conditions of $0<a/A\leqq 1$.

Further, in order to solve the above problems, another application apparatus for application fluid according to the present invention relatively moves a base material wherein stripe-shaped vertical barrier ribs are formed on the surface of the base material and horizontal barrier ribs having a height equal to or lower than the vertical barrier ribs are formed in a direction generally orthogonal to the vertical barrier ribs and a die provided facing the base material, while discharging application fluid from a plurality of discharge orifices provided on the die, thereby applying application fluid to selected grooves between the vertical barrier ribs of the base material, wherein the area (a) of discharge orifices of the die is stipulated such that the area (a), cross-sectional area (A) of grooves formed between the vertical barrier ribs and horizontal barrier ribs, the height (H) of the vertical barrier ribs, the length (L) of the application direction between horizontal barrier ribs, the height (Hh) of the horizontal barrier ribs, the length (Lh) of the application direction of one horizontal barrier rib, and the ratio (k) of application amount between a substrate with horizontal barrier ribs and a substrate with no horizontal barrier ribs, satisfy the following conditions (1) and (2).

$$K=1-(Hh/H)\cdot(Lh/(L+Lh)) \quad (1)$$

$$0<a/(k\cdot A)\leqq 1 \quad (2)$$

While the application method and apparatus for application fluid according to the present invention may be applied to a wide range of technical fields, this is particularly optimally used with an apparatus and method for applying application fluid of a paste containing a fluorescent substance for one color of red, green, or blue, to a plasma display light emitting substrate.

With an application method and apparatus for application fluid such as described above, the,diameter (D) of the discharge orifices of the die and the height (Hh) of the horizontal barrier ribs and the spacing (C) between a discharge orifices forming plate of the die and a bottom face of grooves formed of the vertical barrier ribs and horizontal barrier ribs of the base material must satisfy the conditions of D+Hh<C. The paste-state application fluid discharged from the discharging orifices has a shape that is generally unchanged immediately following application, i.e., maintaining the form of the discharge orifices. Accordingly, in the event that the diameter of the discharge orifice is (D), the risk of the application fluid following application adhering to the discharge orifice formation plate of the die is resolved in the event that the sum of the diameter (D) and the height (Hh) of the horizontal barrier ribs is not smaller than the spacing (C). Also, in the event that the discharge orifice of the die is a non-circular shape, the problem of the discharged paste adhering to the discharge orifice formation face of the die is resolved in the event that the opening dimensions (B) of the discharge orifice following the direction of application of the application fluid satisfy the conditions of B+Hh<C.

Also, the relative velocity (V) between the base material and die and the discharge velocity (v) of the application fluid from the discharge orifices must satisfy the conditions of $0<V/v\leqq 1$. The paste-state application fluid discharged from the discharging orifices bends in the direction of relative movement between the die and base material. Also, there is the possibility that the application fluid might seep across the discharge orifice forming plate due to the relation between the bending of the paste and the wettability of the face of the discharge orifice forming plate having the discharge orifices. However, once the application fluid seeps across the discharge orifice forming plate, there is the risk of the application fluid being discharged from the discharge orifices further spreading on the discharge orifice forming face. The discharge angle of the application fluid must be adjusted in order to apply the application fluid on the base material in spite of this wetting action. As shown in FIG. 3, the discharge angle (θ) may be expressed by $\tan\theta=V/v$, by the movement velocity of the base material 100 or the die 105 in the application direction (the direction of the arrow) and the discharge velocity (v) of the paste 108 from the discharge orifice 106. That is to say, the smaller θ is, the smaller the risk of the application fluid 108 adhering to the face 109 is, and experimentation has shown that adhering of the application fluid 108 to the face 109 can be prevented up to θ=45°. Accordingly, the conditions of $0<V/v\leqq 1$ must be satisfied.

Also, the application fluid 108 must fill the groove 110 full, and the application amount (Q) per unit time is $Q=a\cdot v=A\cdot V$, and accordingly can be expressed by $\tan\theta=V/v=a/A$ with the area (a) of discharge orifices of the die and the cross-sectional area (A) of the groove formed between the vertical barrier rib. Accordingly, the conditions of $0<a/A\leqq 1$ must be satisfied.

Also, the amount of application to grooves of a substrate with horizontal barrier ribs may be less by that to a substrate without horizontal barrier ribs, by the volume of the horizontal barrier ribs. Paste is applied uniformly to substrates, with horizontal barrier ribs in the same manner as with substrates without horizontal barrier ribs, so paste is stacked upon the horizontal barrier ribs immediately following application. However, due to letting stand for a certain amount of time (leveling), the paste on the horizontal barrier ribs flows down into the grooves between the horizontal barrier ribs, so the amount filling the application grooves between the horizontal barrier ribs reaches the necessary amount (full).

Now, let us say that the amount of application per unit length to the grooves on a substrate with horizontal barrier ribs is Qh, and the amount of application to the grooves on a substrate without horizontal barrier ribs is Q. In FIG. 4, with the groove width as W, the Qh per unit length (Lh+L) is $$Qh=W\cdot H\cdot L+W\cdot(H-Hh)\cdot Lh.$$

Also, Q in the event that there are no horizontal barrier ribs is $$Q=W\cdot H\cdot(Lh+L).$$

Accordingly, the ratio k between the amount of application Qh to the grooves on a substrate with horizontal barrier ribs and the amount of application Q to the grooves on a substrate without horizontal barrier ribs can be expressed by $$\begin{aligned} k &= Qh/Q \\ &= [W\cdot H\cdot L+W\cdot(H-Hh)\cdot Lh]/[W\cdot H\cdot(Lh+L)] \\ &= 1-(Hh/H)\cdot(Lh/(L+Lh)). \end{aligned}$$

Also, there is the need to set the discharge angle (θ) to θ=45° in this case as well, so there is the need to satisfy the conditions of $0<a/(k\cdot A)\leqq 1$.

BEST MODE FOR CARRYING OUT THE INVENTION

Figure 1:
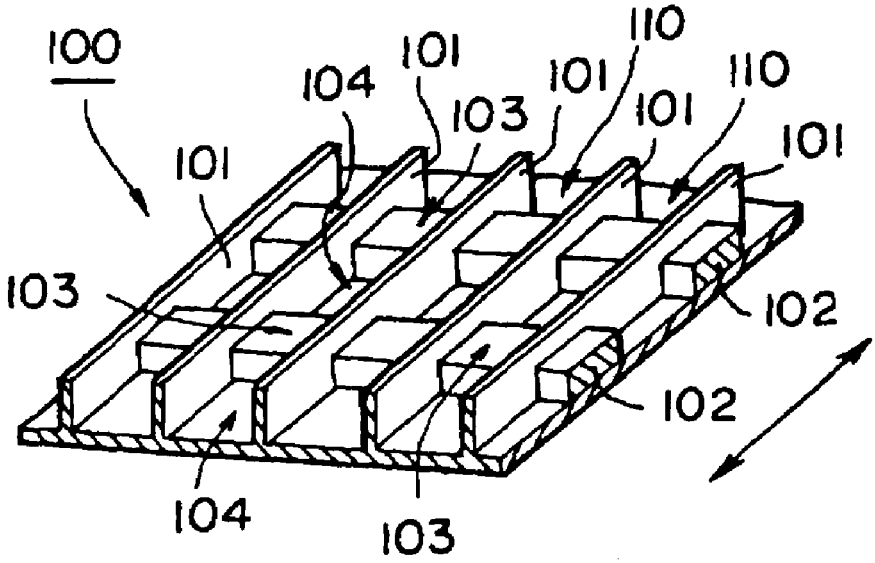
FIG. 1 is a perspective diagram of a substrate having lattice-shaped grooves.
Figure 2:
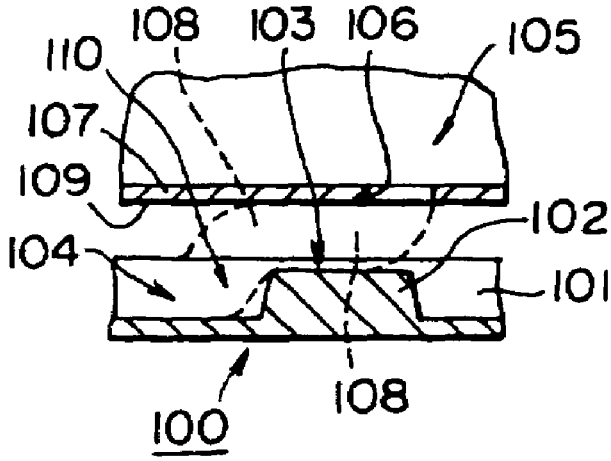
FIG. 2 is an enlarged cross-sectional view illustrating the positional relation between the die of a conventional application apparatus for application fluid and a substrate.
Figure 3:
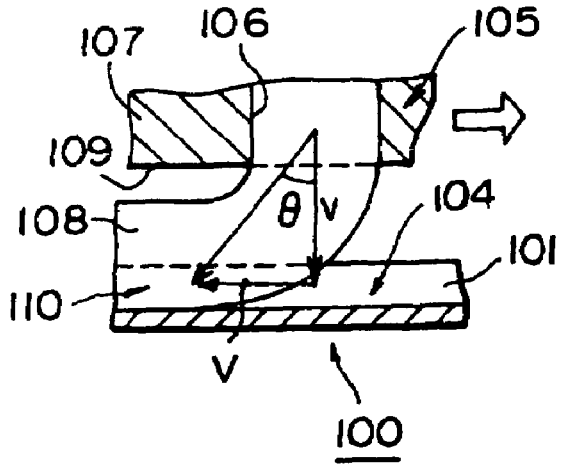
FIG. 3 is a cross-sectional diagram describing the relation between the discharge speed and application speed.

The present invention is a die, having multiple discharge orifices arrayed in a generally straight line for applying an application fluid to an object of application, and an internal application fluid reservoir, wherein a brace is provided in the application fluid reservoir and extends in a direction generally orthogonal to the direction of the array of the discharge orifices.

The die has multiple application fluid supplying openings for supplying application fluid to the application fluid reservoir of the die, wherein each of the application fluid supplying openings are connected to a tournament-ladder-shaped channel for branching the flow of application fluid from an application fluid supply source upstream and supplying to each of the application fluid supplying openings.

Preferably, the flow of supply of the application fluid from each of the application fluid supplying openings is changed over time, or, in the course of repeating application of application fluid to the base material and supplying of application fluid to within the application fluid reservoir of the die, the flow of application fluid supplied from each application fluid supplying opening is changed each time supplying is performed, so that that the position wherein the application fluid supplied from each of the application fluid supplying openings merges within the application fluid reservoir does not remain at a certain fixed position, thereby applying the application fluid.

Upon relatively moving a base material wherein stripe-shaped vertical barrier ribs are formed on the surface thereof and horizontal barrier ribs having a height equal to or lower than the vertical barrier ribs are formed in a direction generally orthogonal to the vertical barrier ribs, and a die provided facing the base material, while discharging application fluid from multiple discharge orifices provided on the die, thereby applying application fluid to selected grooves between the vertical barrier ribs of the base material, the diameter.(D) of the discharge orifices of the die, the height (Hh) of the horizontal barrier ribs, and the spacing (C) between a face having the discharge orifices of the die and a bottom face of grooves formed by being encompassed by the vertical barrier ribs and horizontal barrier ribs of the base material, preferably satisfy the conditions of $D+Hh<C$ by stipulating the diameter (D) and spacing (C).

In a method for applying application fluid by relatively moving a base material wherein stripe-shaped vertical barrier ribs are formed on the surface thereof and a die provided facing the base material while discharging application fluid from a plurality of discharge orifices provided on the die, thereby applying application fluid to selected grooves between the vertical barrier ribs of the base material, the relative velocity (V) between the base material and die and the discharge velocity (v) of the application fluid from the discharge orifices of the die preferably satisfy the conditions of $0<V/v\leqq 1$.

The following is a description of preferred examples of the present invention.

Figure 5:
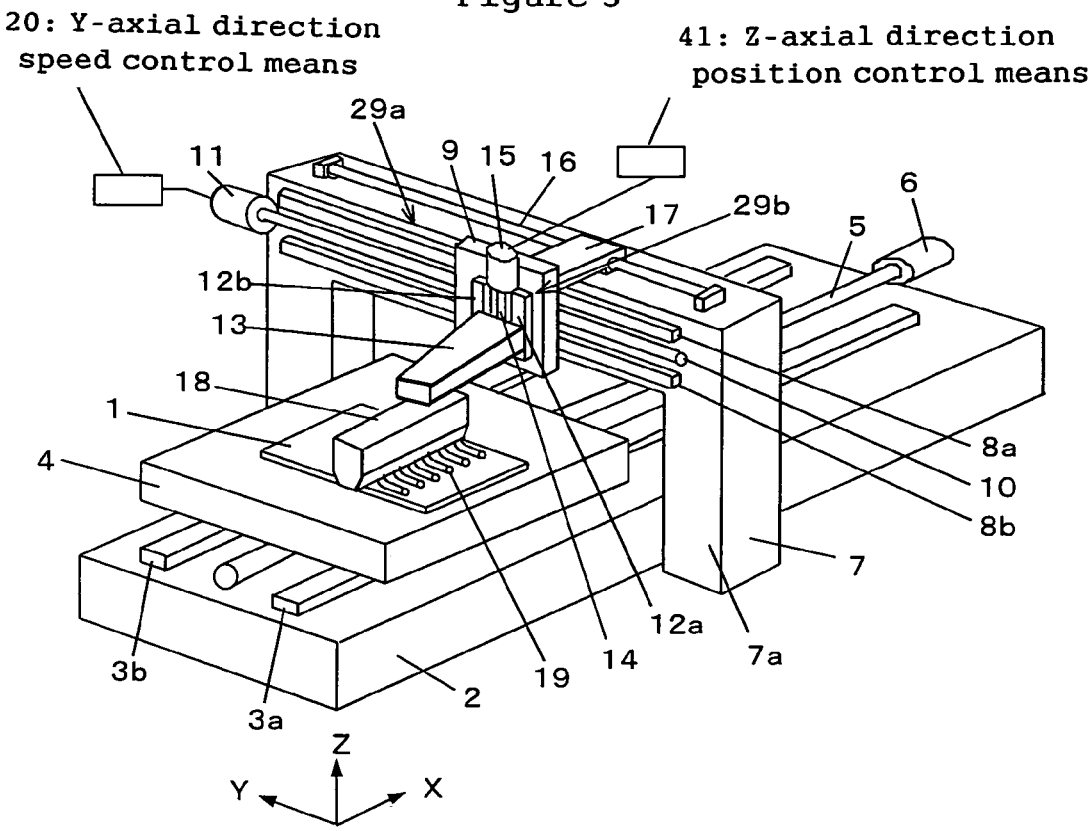
FIG. 5 is a perspective view of a die according to an example of the present invention and an application apparatus using the die.

FIG. 5 is a perspective view of a die according to the present invention, and an application apparatus for application fluid using the die. This application apparatus is an apparatus for forming multiple rows of stripe-shaped application portions of application fluid in a predetermined direction on the upper face of an application-receiving base material 1 (a plasma display light-emitting substrate in the present example). In FIG. 5, the applying apparatus has X slide rails 3*a* and 3*b* which extend in the X-axial direction on an apparatus base 2. An X slide table 4 capable of sliding in the X-axial direction is provided on the X slide rails 3*a* and 3*b*. A driving shaft 5 for sliding the table 4 in the X-axial direction is engaged with the X slide table 4. The X slide table 4 is slid in the X-axial direction by an X-axial motor 6. The base material 1 is positioned on the X slide table 4 and detachably supported by suction.

A gate-shaped supporting apparatus base 7 is provided above the apparatus base 2 so as to straddle it. The supporting apparatus base 7 has Y slide rails 8*a* and 8*b* which extend in the Y-axial direction face on the side 7*a* at the near side. A Y slide table 9 capable of sliding in the Y-axial direction is provided on the Y slide rails 8*a* and 8*b*. A driving shaft 10 for sliding the table 9 in the Y-axial direction is engaged with the Y slide table 9. The Y slide table 9 is slid in the Y-axial direction by a Y-axial motor 11. The X slide table 4, Y slide table 9, etc., make up a first moving means 29a for relatively moving the die 18 and application-receiving base material 1 in the application directions (X-axial and Y-axial directions).

Provided on the Y slide table 9 are Z slide rails 12*a* and 12*b* which extend in the Z-axial direction. A Z slide table 13 capable of sliding in the Z-axial direction is provided on the Z slide rails 12*a* and 12*b*. A driving shaft 14 for sliding the table 13 in the Z-axial direction is engaged with the Z slide table 13. The Z slide table 13 is slid in the Z-axial direction, i.e., in the direction of moving the die 18 closer to and away from the base material 1, by a Z-axial motor 15 linked to Z-axial direction position control means. Thus, second moving means 29*b* are configured.

The die 18 is attached to the Z slide table 13. A position sensor 17 for detecting the position of the die 18 in the Y-axial direction is attached to the Y slide table 9. The position sensor 17 is movably supported on a sensor supporting shaft 16 provided on the upper face of the supporting apparatus base 7 in the Y-axial direction. Y-axial direction speed control means 20 for changing the moving speed of the Y slide table 9 are linked to the Y-axial motor 11.

The die 18 is moved in the Y-axial direction in FIG. 5, discharges application fluid from multiple discharging orifices 18*a* provided at predetermined intervals in a generally straight line on a discharge orifice forming member 32 of the die 18, and forms multiple rows of application stripes 19 on the base material 1. Note that the discharge orifices 18*a* may be arrayed at equal intervals, but also may be formed wherein the intervals are be changed at predetermined cycles.

Figure 6:
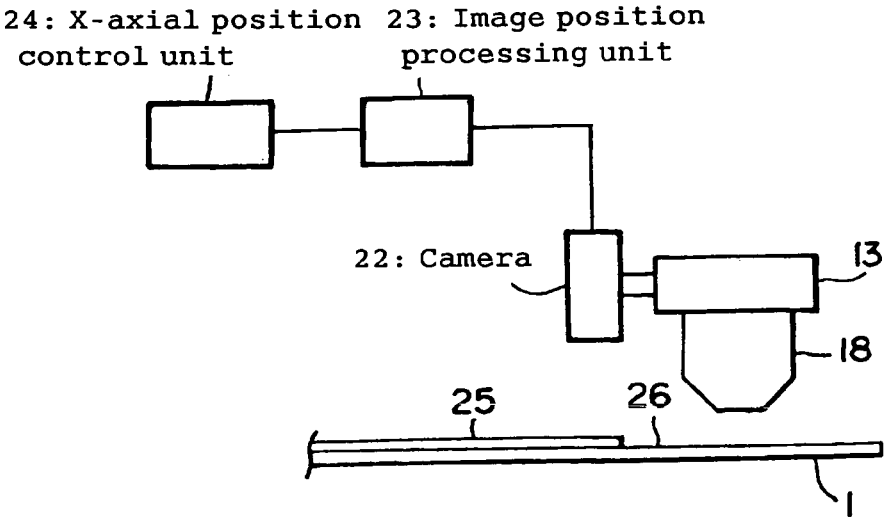
FIG. 6 is a schematic diagram of around the die, viewing the application apparatus shown in FIG. 5 from the X-axial direction.
Figure 7:
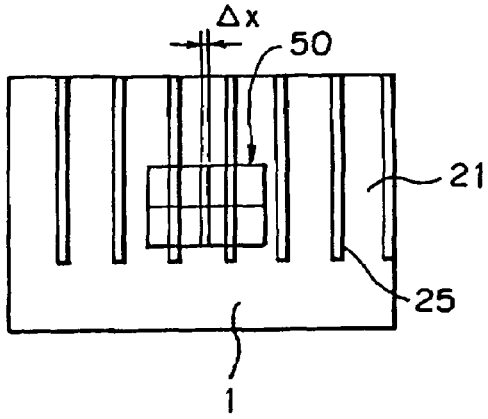
FIG. 7 is a schematic diagram illustrating an image of a recess and a cursor for image processing.

FIG. 6 illustrates around the die 18, viewing the application apparatus shown in FIG. 5 from the X-axial direction. A camera 22 attached to the Z slide table 13 takes an image of a representative recess 21 on the base material 1, the X slide table 4 is moved with an X-axial position control unit 24 via an image position processing unit 23, and control is made such that the center of the representative recess 21 and the center of a representative discharge orifice 18*a* of the die 18 corresponding to the representative recess 21 match. That is to say, as shown in FIG. 7, the difference $\Delta X$ between the image of the representative recess 21 of the base material 1 and the center of the cursor 50 for image processing is corrected by moving the X slide table 4 in the X-axial direction.

Note that the aforementioned recess 21 is a recess 21 at the center in the recess array direction. Also, the representative discharge orifice 18*a* is a discharge orifice 18*a* at the center in the array direction. Setting the representative recess 21 and representative discharge orifice 18*a* respectively to a recess 21 and discharge orifice 18*a* at the center in the array direction of each allows positional offset between the centers of the recess 21 and discharge orifice 18*a* at the ends in the array direction to be suppressed to a minimum.

Figure 8:
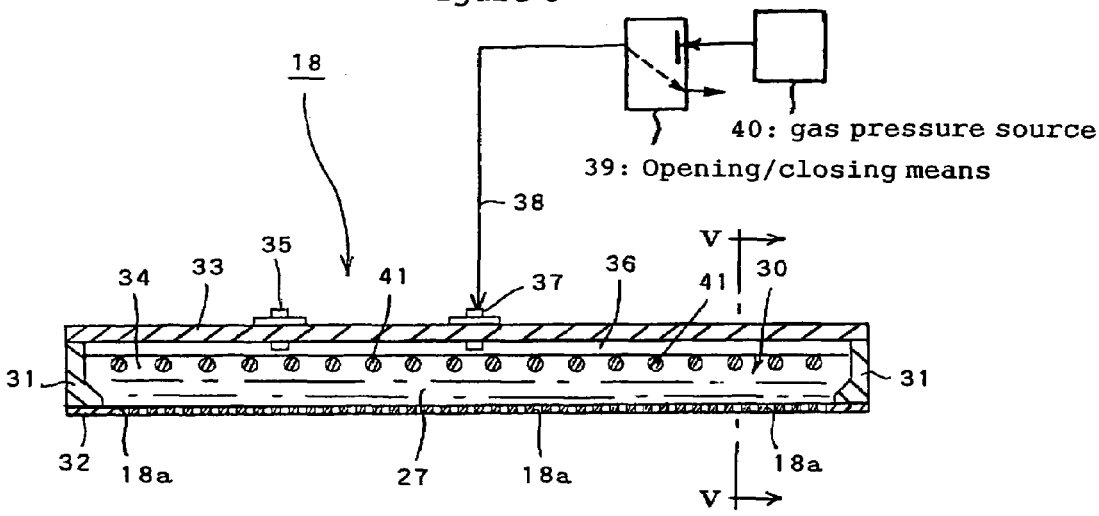
FIG. 8 is a cross-sectional view of the die of the application apparatus shown in FIG. 5.

FIG. 8 is a vertical cross-sectional diagram of the die 18. The die 18 has an application fluid reservoir forming member 31 wherein an application fluid reservoir 30 is formed within, and a discharge orifice forming member 32 and lid member 33 which are mutually fit with the member 31. Note that the members 31, 32, and 33 may be powerfully joined one to another by welding, diffusion joining, adhesion, tightening with bolts, and so forth. The lid member 33 is provided with an application fluid supplying opening 35 for supplying application fluid 34 into the application fluid reservoir 30, and a compressed air supply opening 37 for sending compressed air into a space portion 36 formed above the application fluid reservoir 30.

One end of a gas pressure conducting channel 38 formed of a pipe is linked to the compressed air supply opening 37. The other end of the gas pressure conducting channel 38 is opened to a gas pressure source 40 having pressure supported to a set pressure. Opening/closing means 39 formed of a direction switching value are provided to the gas pressure conducting channel 38, and the space portion 36 and gas pressure source 40 communicate or are cut off by opening/closing switching of the opening/closing means 39. Upon the space portion 36 and gas pressure source 40 communicating, compressed air is sent into the space portion 36, the internal pressure of the space portion 36 rises, and accordingly, a predetermined amount of application fluid 30 is discharged from the discharge orifice 18*a*. The opening/closing means 39 detect the relative position of the discharge orifice 18*a* of the die 18 and the base material 1, and the timing for opening and closing is controlled by position detecting and discharge controlling means not shown in the drawings, for controlling the timing of the opening/closing means 39.

Figure 9:
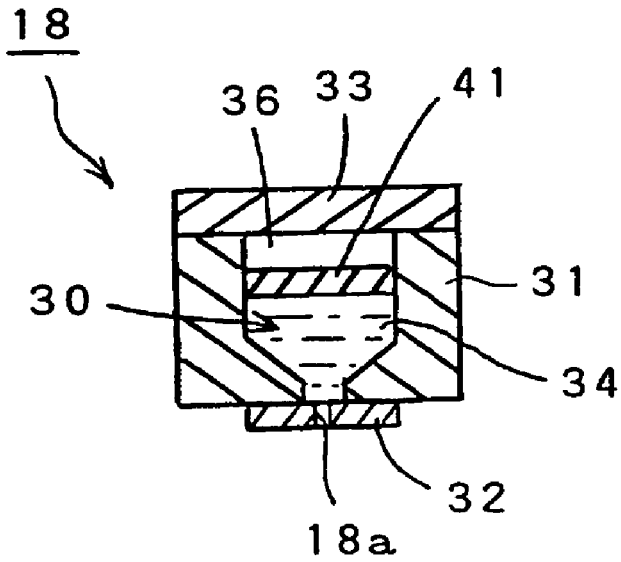
FIG. 9 is a cross-sectional diagram following the line V—V on the die shown in FIG. 8.
Figure 10:
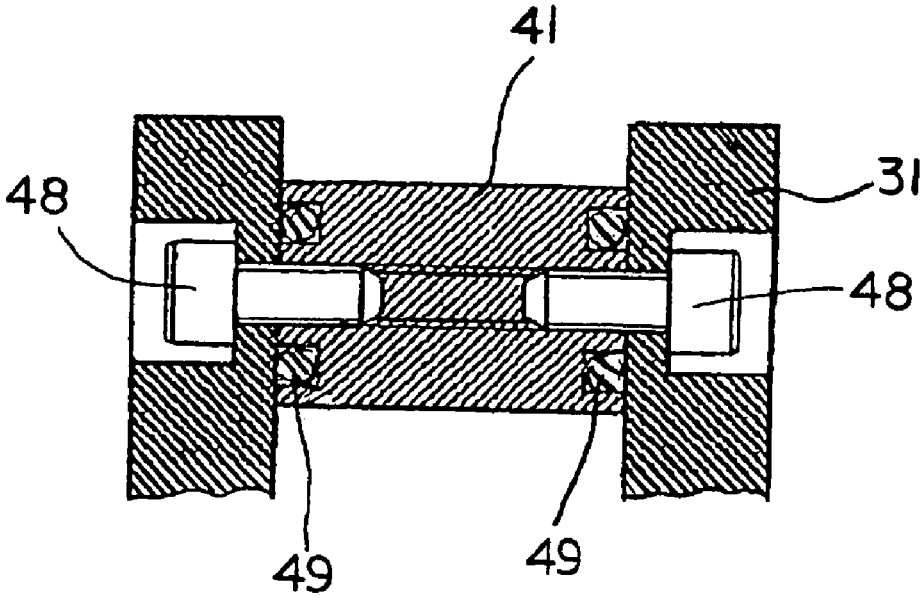
FIG. 10 is an enlarged cross-sectional diagram of the die wherein the braces and application fluid reservoir forming members have been joined by bolts.

Braces 41 extending in a direction orthogonal to the array direction of the discharge orifices 18*a* are provided within the application fluid reservoir 30, as shown in FIG. 8 and FIG. 9. Multiple braces 41 are arrayed at equal intervals following the array direction of the discharge orifices 18*a*. Though the braces 41 have a circular cross-sectional form in the present example, the shape is not restricted to this, and may be formed as ellipses, triangles, squares, wing profiles, and so forth. Also, the braces 41 and application fluid reservoir forming member 31 may be fastened by bolts 48, as shown in FIG. 10. O-rings 49 are introduced at the plane of contact between the braces 41 and member 31, securing sealing for that portion. Though the present example illustrates a type wherein a space portion 36 is formed within the die 18, the present invention can also be applied to a type of die wherein there is no space portion 36 and the application fluid 34 fills the interior or the die.

Figure 11:
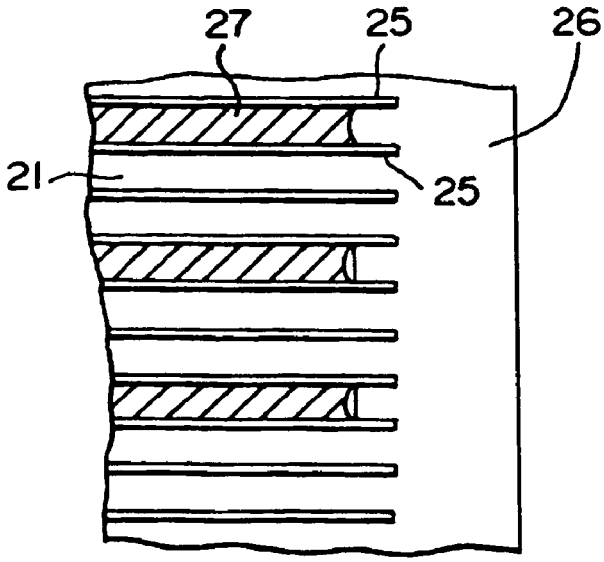
FIG. 11 is a schematic diagram viewing the recesses on the substrate from above.
Figure 12:
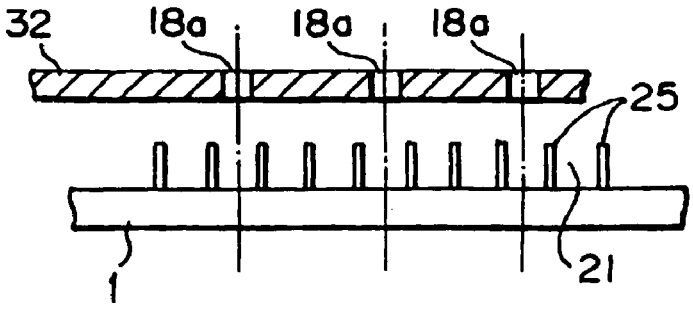
FIG. 12 is a schematic diagram illustrating the positional relation between the discharge orifices and the recesses.

FIG. 11 is a detailed view of the recess 21 formed on the base material 1 from above. Fluorescent substance paste 27 (application fluid 34) of one of the colors of red, blue, or green, is filled in the recess 21, and recesses 21 formed of barrier ribs 25 (vertical ribs) at a predetermined pitch stop at the end of the display portion and are not formed on a non-display portion 26. With the present example, application fluid of the same color can be applied to every third recess 21, as shown in FIG. 12. Accordingly, the pitch of the discharge orifices 18*a* is three times the pitch of the barrier ribs 25. Note that the base material 1 may have horizontal ribs orthogonal to the barrier ribs 25, so that recesses 21 are formed in the shape of a lattice.

With the present example, braces 41 extending in a direction orthogonal to the array direction of the discharging orifices 18*a* are provided to the application fluid reservoir 30 of the die 18, so pressure-resistant strength with regard to internal pressure in the array direction of the discharging orifices 18*a* of the die 18, i.e., in the width direction of the die 18 can be markedly improved, so deformation and the like of the die 18 can be effectively prevented and application fluid can be uniformly applied onto the base material 1.

Also, the braces 41 are disposed at equal intervals in the direction following the array direction of the discharging orifices 18*a*, so pressure-resistant strength with regard to internal pressure over the entire longitudinal direction of the die 18 can be uniformly improved.

Also, according to the structure wherein braces 41 such as with the present example are provided, increases in costs can be markedly reduced in comparison with configurations wherein the members making up the die are formed thicker in order to improve the pressure-resistant strength with regard to internal pressure of the die. Also, increased weight can be suppressed, and detaching and mounting work for the die 18 can be made easier.

Figure 13:
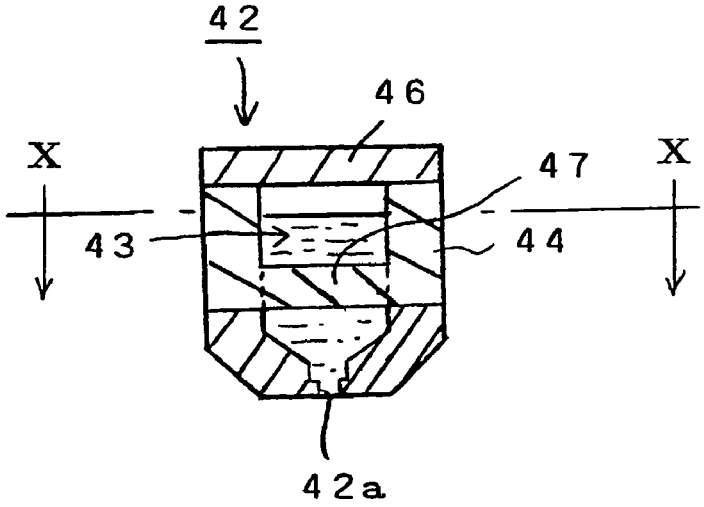
FIG. 13 is a cross-sectional view of a die according to another example of the present invention.
Figure 14:
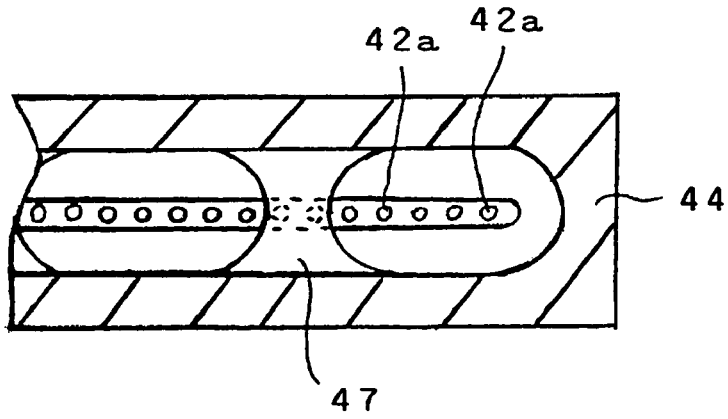
FIG. 14 is a cross-sectional view of the die shown in FIG. 13, along line X—X.

FIG. 13 and FIG. 14 illustrate a die according to a second example of the present invention. With the present example, the die 42 comprises application fluid reservoir forming members 44 which form an application fluid reservoir 43, and a discharge orifice forming member 45 and a lid member 46 mutually joined with the members 44. Braces 47 extending in a direction orthogonal to the array direction of the discharge orifices 42*a* are provided within the application fluid reservoir 43. Multiple braces are formed integrally with the application fluid reservoir forming members 44, and arrayed following the direction of array of the discharge orifices 42*a*.

With the present example as well, the pressure-resistance strength with regard to internal pressure of the die 42 can be uniformly improved along the direction of array of the discharge orifices 42*a*, so deformation of the die 42 can be prevented while suppressing increased weight and increased costs.

Also, with the present example, the braces 47 are formed integrally with the application fluid reservoir forming members 44, so increase in the number of parts making up the die 42 can be prevented, while improving the handlability of the die 42 at the time of assembly, and so forth.

Next, another preferable example of the present invention will be described with reference to the drawings.

First, an example of the overall configuration of the application apparatus for application fluid according to the present example, and particularly the overall configuration of the application apparatus for applying application fluid to an uneven base material (e.g., a plasma display panel base material) will be described.

Figure 15:
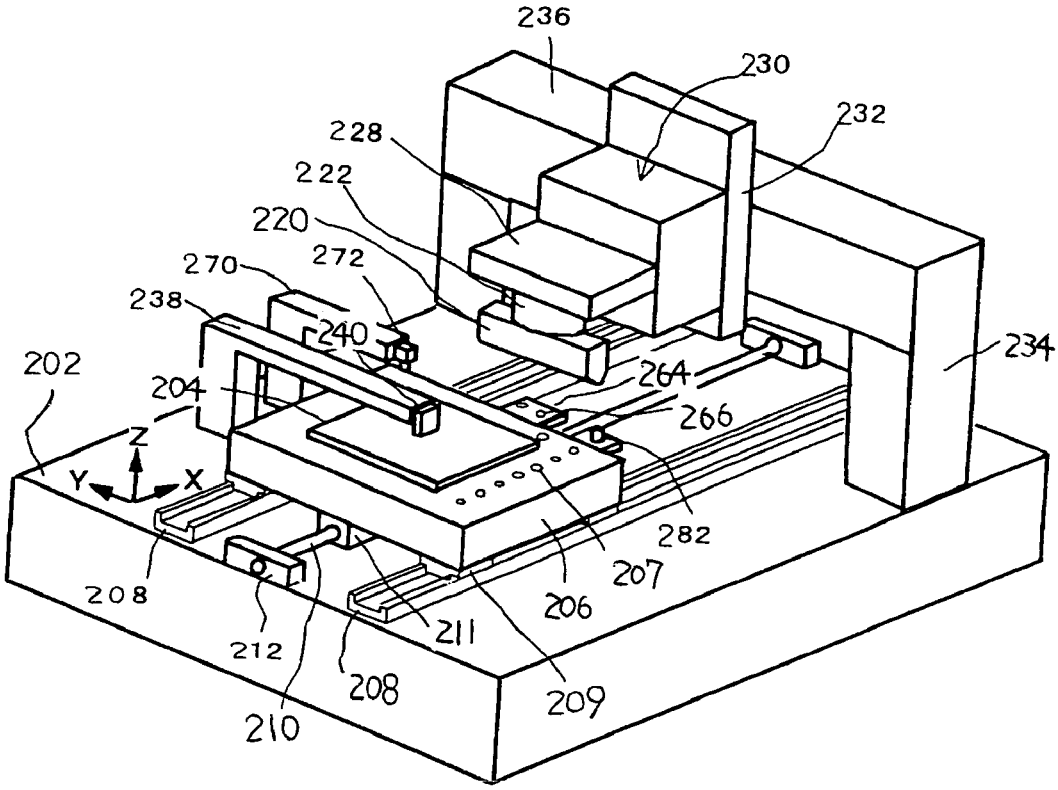
FIG. 15 is an entire perspective view of an application apparatus for application fluid according to an example of the present invention.
Figure 16:
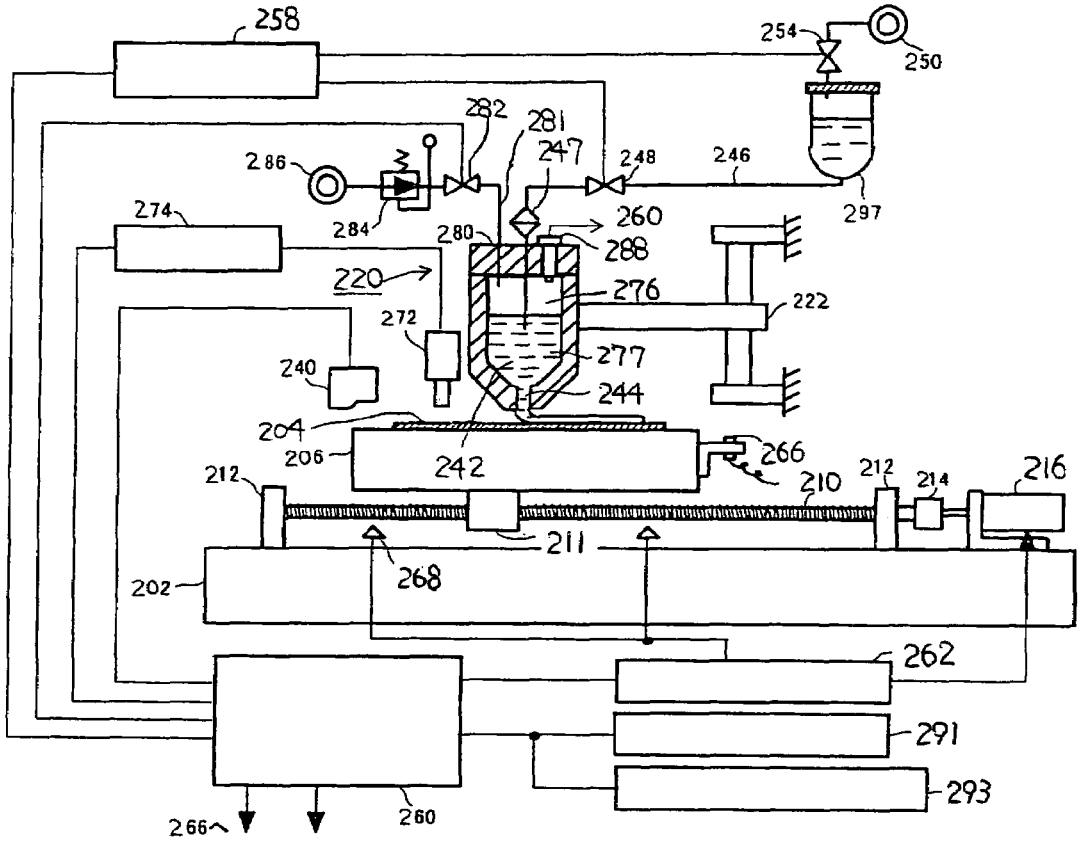
FIG. 16 is a model diagram indicating the configuration of the table and around the die of the apparatus shown in FIG. 15.

FIG. 15 is an overall perspective view of an application apparatus for application fluid according to an example of the present invention, and FIG. 16 is a pattern diagram of around the table 206 and die 220 shown in FIG. 15.

First, description will be made regarding the overall configuration of the application apparatus for application fluid. FIG. 15 illustrates an example of an application apparatus employed in manufacturing the plasma display panel according to the present invention. This apparatus has an apparatus base 202. A pair of guide groove rails 208 are provided on the apparatus base 202, and a table 206 is provided on the guide groove rails 208. Multiple suction holes 207 are provided on the upper face of the table 206 such that a base material 204 with unevenness formed in the shape of stripes on the surface thereof at a constant pitch in one direction can be fixed to the table face by vacuum suction. Also, the base material 204 rises and descends on the table 206 by unshown lift pins. Further, the table 206 is capable of reciprocal motion in the X-axial direction on the guide groove rails 208 by slide legs 209.

A feed screw 210 comprising a feeding screw mechanism shown in FIG. 16 extends between a pair of guide groove rails 208 and through a nut-shaped connector 211 fixed on the lower face of the table 206. Both ends of the feed screw 210 are rotatably supported by bearings 212, and an AC servo motor 216 is further linked to one end thereof by a universal joint 214.

As shown in FIG. 15, the die 220 for discharging the application fluid is linked to an elevator mechanism 230 and width-direction moving mechanism 236 through a holder 222, above the table 206. The elevator mechanism 230 has an elevator bracket 228 capable of rising and descending, and is attached to a pair of guide rods within the casing of the elevator mechanism 230 so as to be capable of rising and descending. Also, a feed screw (not shown) formed of a ball screw is also rotatably disposed within this casing, positioned between the guide rods, and is linked with the elevator bracket 228 by a nut-type connector. Further, an unshown AC servo motor is connected at the upper end of the feed screw, so that the elevator bracket 228 can be arbitrarily raised or lowered by rotations of this AC servo motor.

Further, the elevator mechanism 230 is connected to the width-direction moving mechanism 236 by a Y-axial moving bracket 232 (actuator). The width-direction moving mechanism 236 is for reciprocally moving the Y-axial moving bracket 232 in the width direction of the die, i.e., in the Y-axial direction. The guide rods, feed screw, nut-type connector, AC servo motor, etc., necessary for operation, are disposed in the casing in the same manner as with the elevator mechanism 230. The width-direction moving mechanism 236 is fixed on an apparatus base 202 with a brace 234. The die 220 is made movable in the Z-axial and Y-axial directions by these configurations.

Further, with reference to FIG. 15, an inverse-L-shaped sensor brace 238 is fixed on the upper face of the apparatus base 202, with a height sensor 240 for measuring the position (height) of the apex of protrusions on the base material 204 on the table 206 being attached to the tip thereof. Also, a camera 272 for detecting the position of the uneven portions of the base material 204 is attached to a brace 270 next to the height sensor 240. As shown in FIG. 16, the camera 272 is electrically connected to an image processing device 274, so that change in the position of the uneven portions can be quantitatively obtained.

Further, a sensor 266, for detecting the position of the lower face (discharge orifice face) of the die 220 where the discharge orifices 224 are in the direction perpendicular to the table 206, is provided on one end of the table 206, by a sensor bracket 264.

Now, FIG. 16 shows an example of the application apparatus according to the present invention, with regard to the portion wherein application fluid and compressed air are supplied to the die 220 and discharged. The die 220 has an application fluid reservoir 277 for storing application fluid within, and has a space portion 276 above the fluid level of the application fluid. The space portion 276 has connected thereto a pressurized air supply hose 281, a pressurized air control valve 282, a decompression valve 284, and a pressurized air source 286, so that pressurized air of an arbitrary pressure can be supplied. The pressurized air control valve 282 is controlled so as to open and shut by an universal controller 260. The pressurized air control valve 282 is controlled to the open state when applying the application fluid, so that the application fluid 242 is discharged from the discharge orifices 244 by the pressing force of the pressurized air supplied to the space portion 276 within the die 220. The diameter of the discharge dies 244 should be set to between 10 to 500 μm, according to the width of applying the application fluid.

With retard to the die 220, the interior of the die preferably can be opened by removing the lid 280, so as to enable cleansing work.

The amount of application fluid within the die 220 is detected each time the applying action stops. The application apparatus according to the present invention has detecting means for detecting the amount of application fluid within the die 226 without contacting the application fluid. Using non-contact detecting means for detection of the amount of application fluid within the application fluid reservoir 277 of the die 220 can prevent soiling by the application fluid. A sensor 288 for detecting the fluid level height of the application fluid is provided as the non-contact detecting means. The sensor 288 is electrically connected with the universal controller 260, with the universal controller 260 controlling the supply device controller 258 according to the detection signals thereof. Also, an arrangement may be made wherein the sensor is not directly fixed to the die 220, but rather is fixed to a sensor bracket (omitted in the drawing) which is a separate member, which means that the sensor 288 is constantly fixed to a separate member even at the time of replacing the die 220, so there is no need to perform adjustment such as positioning the sensor each time the die is replaced. The sensor bracket is preferably capable of moving adjustment in the height direction of the sensor 288 and fixable at an arbitrary position, taking into consideration that detected fluid level height levels differ according to the form specifications of the die 220. With the present invention, sensors capable of non-contact detection such as laser types or ultrasonic types can be used for the sensor 288, and of these, a laser displacement gauge is most preferable due to the detection precision and the broadness of detection range. In this case, preferably, a transparent plate is attached to the die 220, giving consideration so that the fluid level can be detected.

Connected to the die 220 are a filter 247, application fluid supply hose 246, application fluid supply flow adjustment control valve 248, and application fluid tank 297. The application fluid 242 is stored in the application fluid tank 297, and connected to the pressurized air source 250 via the pressurized air control valve 254.

Also, in the above example, signals from the position sensor 268 for detecting the movement position of the AC servo motor 216 for driving the table 206, the actuators 291 and 293 (e.g., AC servo motors) for the elevator mechanism 230 and width-direction moving mechanism 236, and further, the table 206, signals from respective X and Z axial linear sensors (not shown) for detecting the operating position of the die 220, are input to the motor controller 262. Also, instead of using the position sensor 268, an arrangement may be made wherein an encoder is embedded in the AC servo motor 216 and the position of the table 206 is detected based on the pulse signals output from the encoder.

Now, in the overall configuration of the application fluid application apparatus described above, any principle capable of measurement may be used for the height sensor 240, such as non-contact measurement types using laser, ultrasound, etc., contact measurement types using dial gauges, differential transformers, etc., and so forth.

Also, detecting means for detecting the relative position of the discharge orifices 244 of the die to the recesses may be configured of an image processing device using cameras for individually detecting the recesses on the base material and the discharge dies.

Next, examples will be illustrated relating to the die according to the present invention. That is to say, the above-described die 220 and the application fluid supply unit connected thereto may have the following configurations.

Figure 17:
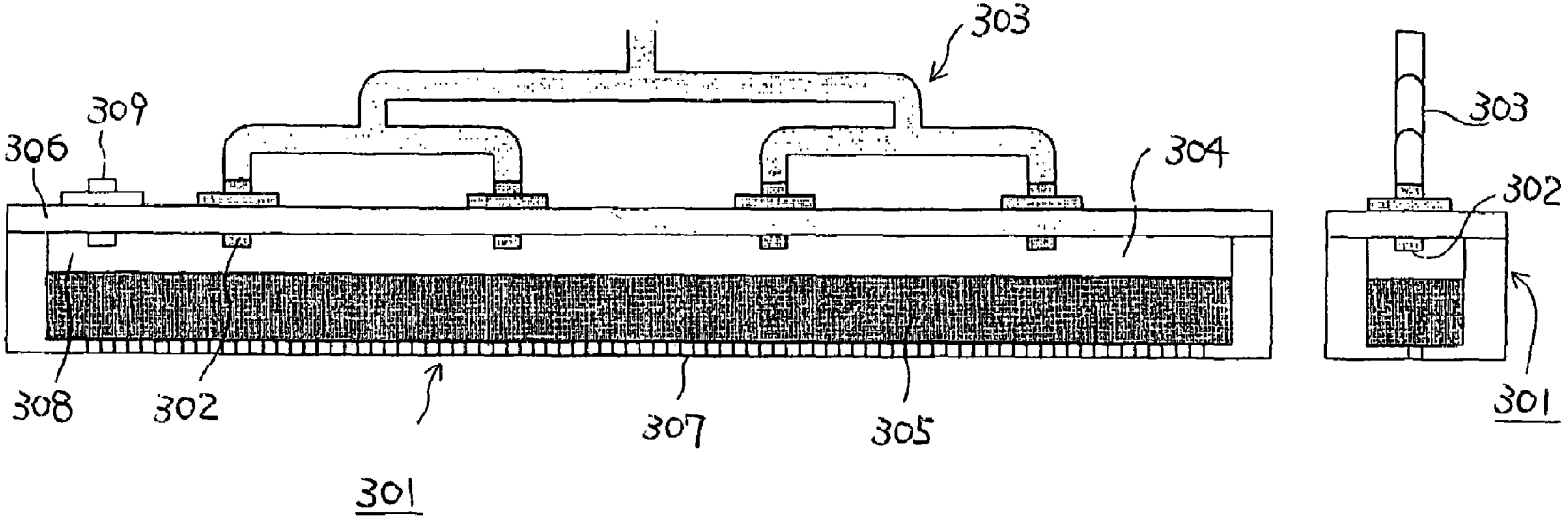
FIG. 17 is a schematic configuration diagram relating to an example of the present invention.

FIG. 17 illustrates a vertical cross-sectional view of a die 301 according to an example of the present invention. Multiple application fluid supplying openings 302 are provided to the die 301, and the application fluid supplying openings 302 are connected to pipes forming a tournament-ladder-shaped channel 303 upstream therefrom. Accordingly, at the time of supplying application fluid 305 to the application fluid reservoir 304 of the die 301, the application fluid 305 can be uniformly distributed from the application fluid supply source, and can be supplied into the application fluid reservoir 304 from the application fluid supplying openings 302. A pressurized air supply opening 309, for supplying to the upper space 308 in order to discharge the application fluid 305 stored in the application fluid reservoir 304 from the discharge orifices 307, is provided to the lid 306 of the die 301. The multiple discharge orifices 307 are arrayed in a straight line, and the multiple application fluid supplying openings 302 are arrayed in a straight line generally parallel to the direction of array of the discharge orifices 307.

Figure 18:
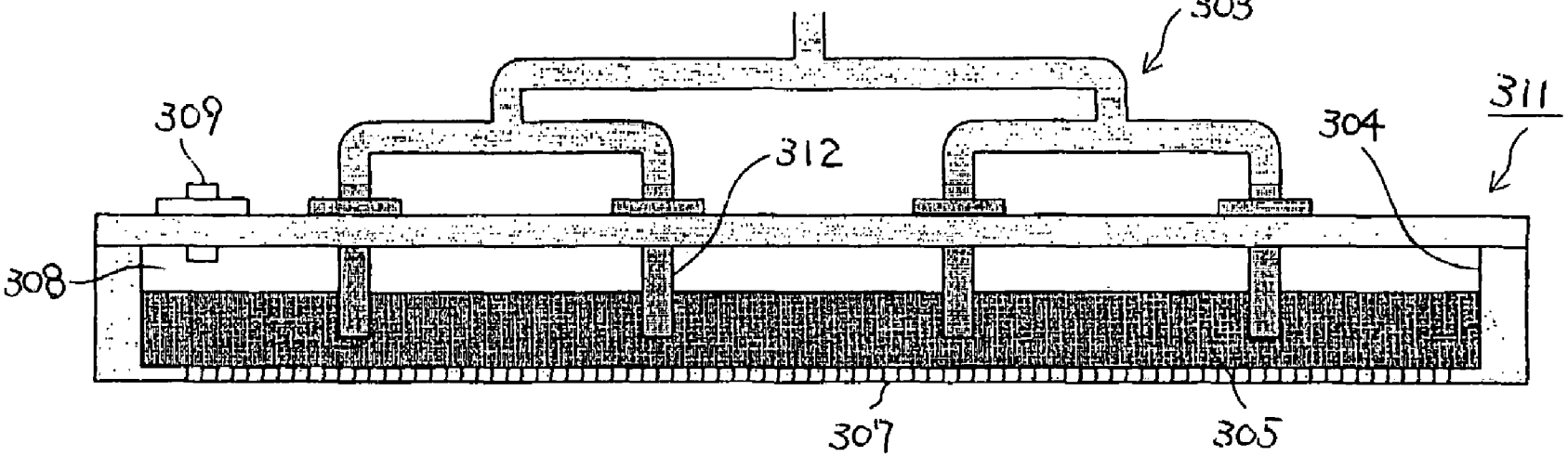
FIG. 18 is a schematic configuration diagram of the die relating to another example of the present invention.

FIG. 18 illustrates a die 311 wherein the tips of the application fluid supplying openings 312 are shaped in the forms of pipes, with the tips thereof immersed in the application fluid 305. Thus, air bubbles can be prevented from being mixed into the application fluid at the time of supplying the application fluid. Also, the intervals between adjacent application fluid supplying openings are preferably all equal with the dies 301 and 311, taking into consideration the flatness of the application fluid level height. Also, in the event that the intervals between the application fluid supplying openings cannot be made equal, or in cases wherein the number of application fluid supplying openings is an odd number or wherein the number is even but is a multiple of 3 so a uniform tournament-ladder-shaped channel cannot be formed, the pressure loss can be made to match and the supply flow adjusted, by changing the channel length or changing the channel diameter, for example, in order to match the amount of supply from the application fluid supplying openings.

Figure 19:
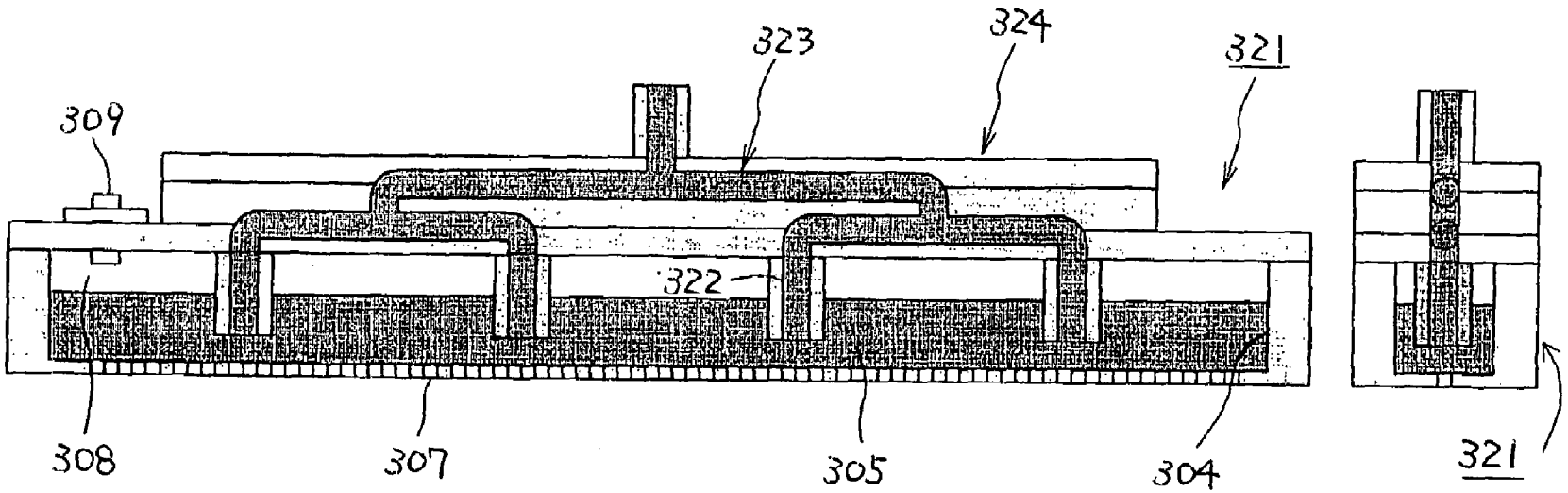
FIG. 19 is a schematic configuration diagram of the die relating to yet another example of the present invention.

FIG. 19 illustrates a die 321 wherein the tournament-ladder-shaped channel 323 upstream from the application fluid supplying openings 322 is formed by applying plates 324 with grooves formed-thereupon, one to another. With pipes such as described above, cleansing the inner walls of the pipes becomes difficult in the event that the pipes are long, but with plates 324 having grooves formed thereupon, these can be disassembled and cleansed, so cleansing is easy, regardless of the length of the channel.

The application fluid can be uniformly distributed within the application fluid reservoir 304 by supplying the application fluid through tournament-ladder-shaped channels 303 and 323 such as described above, so a uniform discharge amount can be obtained from the discharge orifices 307.

Figure 20:
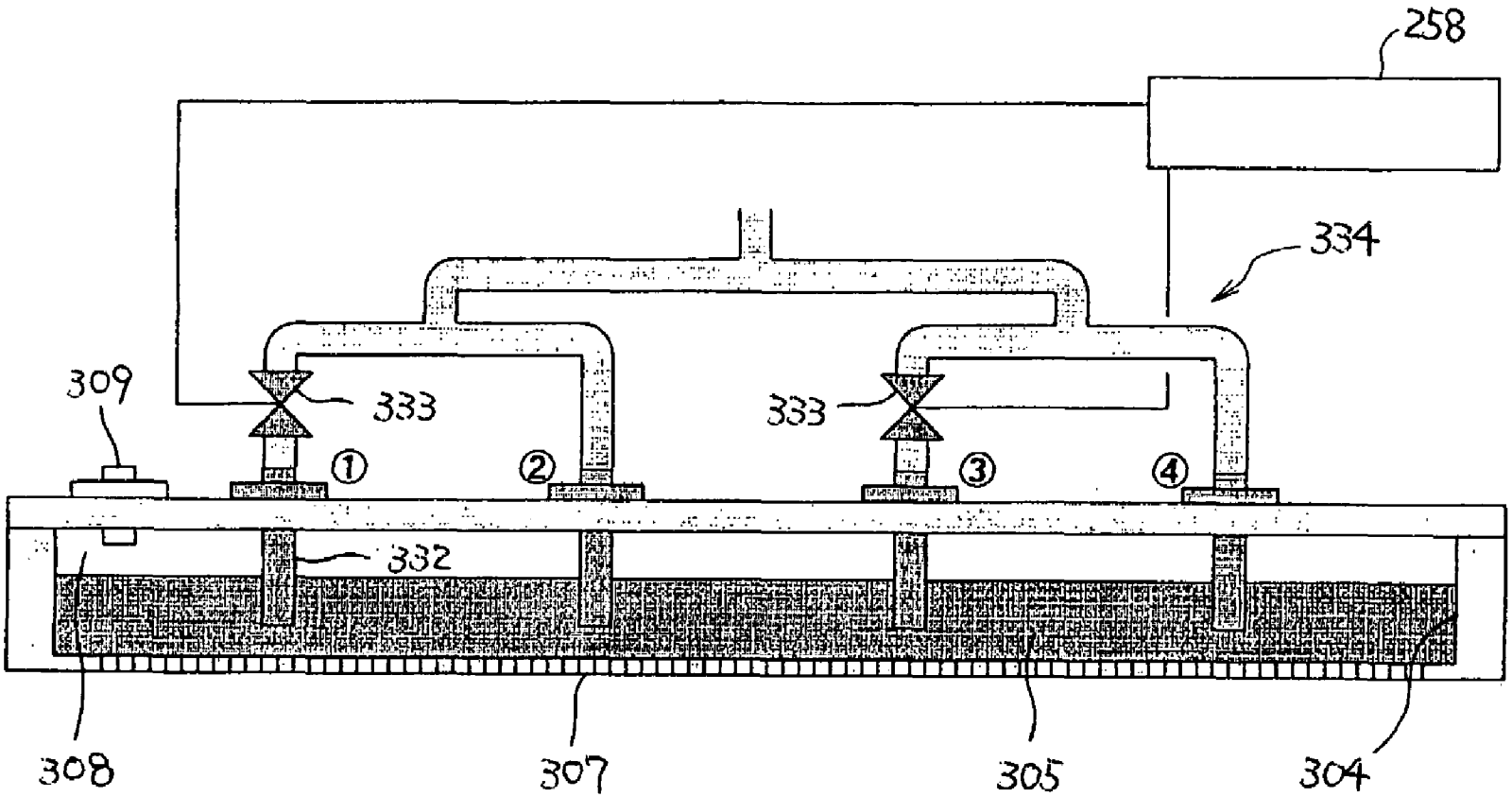
FIG. 20 is a schematic configuration diagram of the die relating to yet another example of the present invention.
Figure 21:
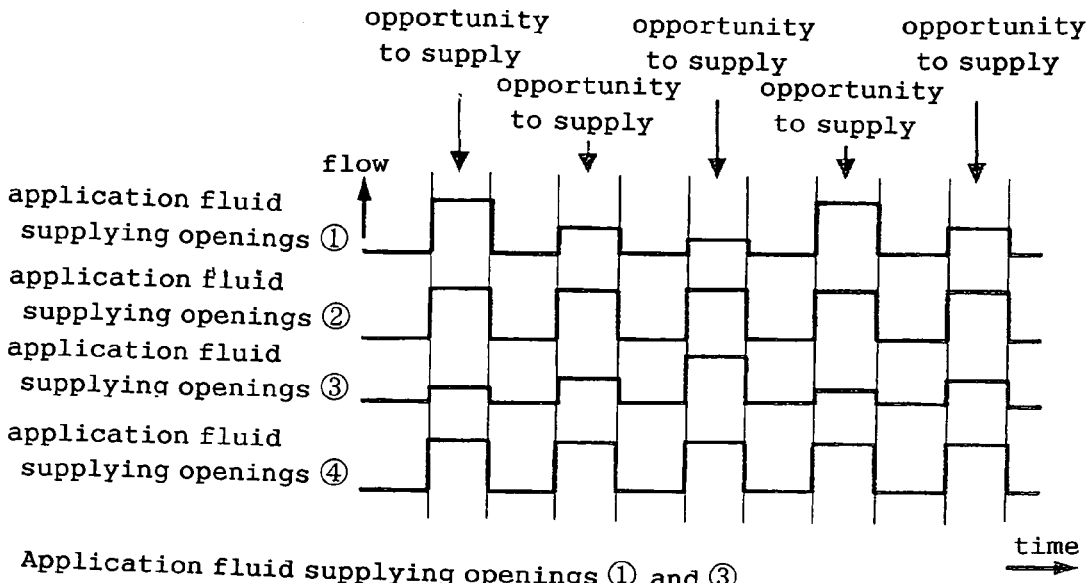
FIG. 21 is a model representation diagram of the supply flow of application fluid from each of the application fluid supplying openings to the application fluid reservoir, according to an example of the present invention.
Figure 22:
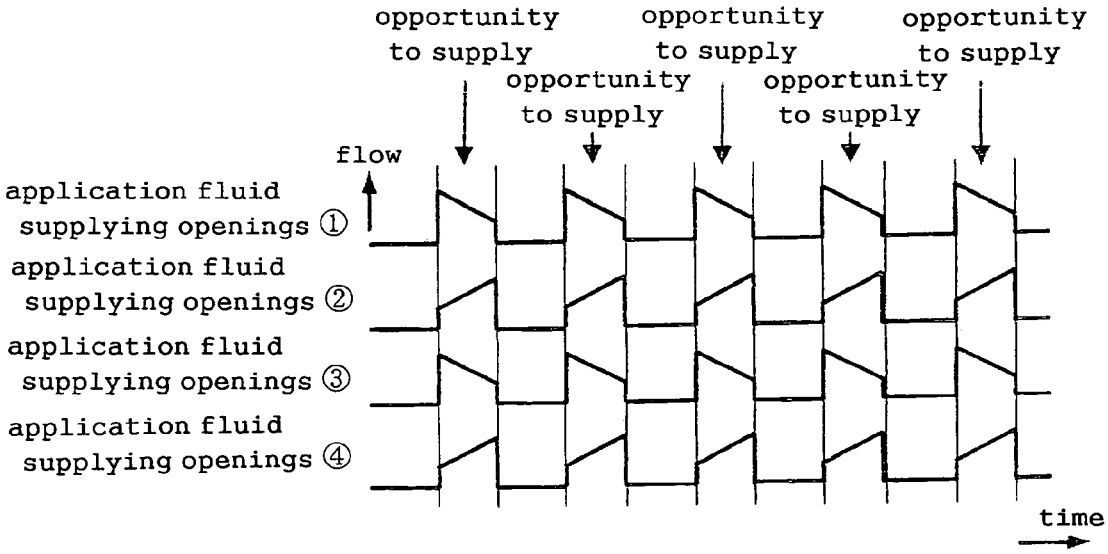
FIG. 22 is a model representation diagram of the supply flow of application fluid from each of the application fluid supplying openings to the application fluid reservoir, according to another example of the present invention.

FIG. 20 illustrates a die 331 provided with a supply flow adjustment control valve 333 provided upstream from the application fluid supplying openings 332, for adjustment control of the supply flow of the application fluid. The degree of opening of the supply flow adjustment control valve 333 can be controlled by electric signals, and the degree of opening thereof is controlled by the supply device controller 258. In the example in the drawing, the supply flow adjustment control valve 333 is provided to one side of channels to pair of application fluid supplying openings 332 branched from the tournament-ladder-shaped channel 334. Accordingly, the application fluid supply flow from each of the application fluid supplying openings can be changed, at each occasion of supplying to within the application fluid reservoir 304 as shown in FIG. 21, or over time for each instance of supplying as shown in FIG. 22, so the position where the application fluid merges within the application fluid reservoir 304 can be oscillated (moved), so that application irregularities do not occur. As shown in the figures, the valve 333 is capable of oscillating the merging position even though it is only at one side of the adjacent application fluid supplying openings.

Figure 23:
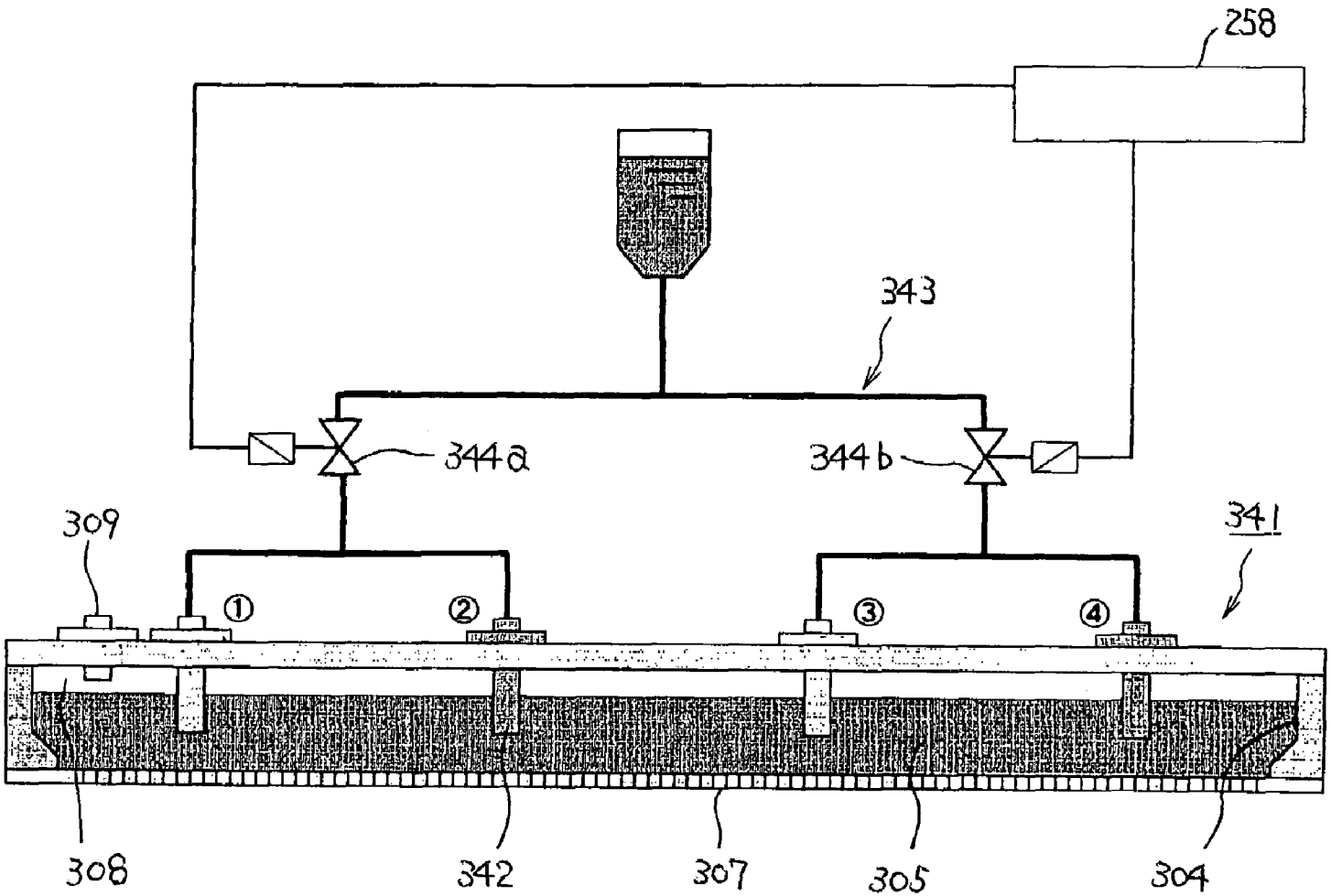
FIG. 23 is a schematic configuration diagram of the die according to yet another example of the present invention.
Figure 24:
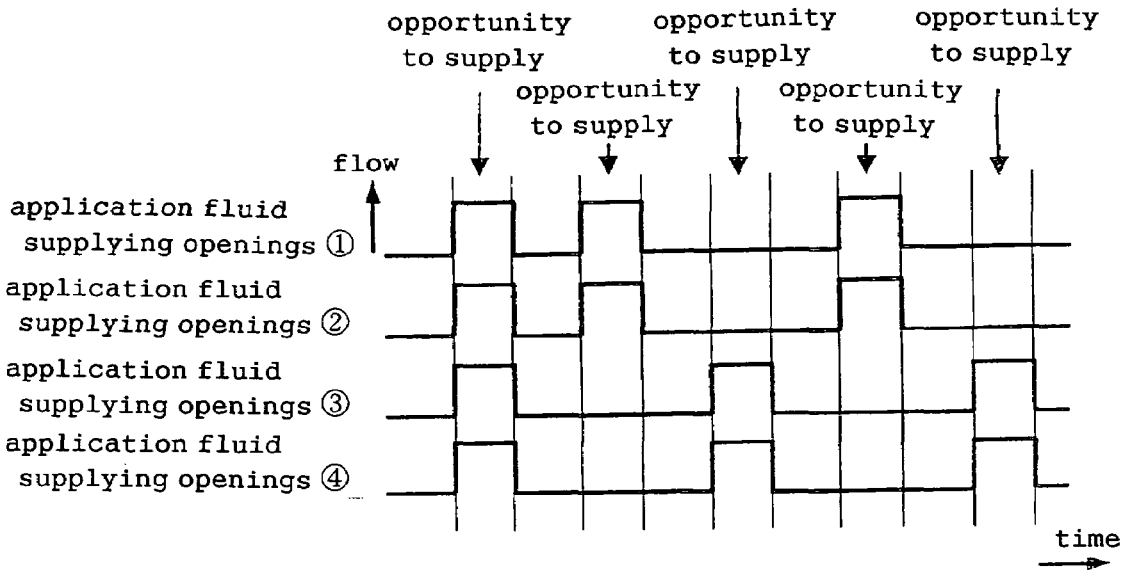
FIG. 24 is a model representation diagram of the supply timing and flow of application fluid from each of the application fluid supplying openings to the application fluid reservoir, according to an example of the present invention.

FIG. 23 illustrates a die 341 wherein the multiple application fluid supplying openings 342 are divided into two groups (groups of ① and ②, and ③ and ④), and connected with a tournament-ladder-shaped channel 343. Supply flow adjustment control valves 344*a* and 344*b* are connected to each of the two groups. The degree of opening of the supply flow adjustment control valves 344*a* and 344*b* can be controlled by electric signals, and the degree of opening thereof is controlled by the supply device controller 258. Thus, supply can be made simultaneously from four places, or supply from only one group can be repeated, such as ① and ② only or ③ and ④ only, at the timing shown in FIG. 24. The control of the supply flow adjustment control valves 344*a* and 344*b* is made with predetermined patterns by the supply device controller 258.

In the case of supplying from ①, ②, ③, and ④, simultaneously, places where the application fluid merges (interfaces) occur between each of the application fluid supplying openings, but as a countermeasure, first, supplying from ① and ② alone causes a merging place to occur between ① and ②, but there is no supply from ③ and ④, so the application fluid flows toward ③ and ④ over time, and the interface where ① and ② merge also moves and is blurred. This does away with application irregularities. However, in the event that supply is made from ① and ② alone indefinitely, the application fluid does not readily flow if the viscosity thereof is high, so the application fluid at the ③ and ④ side may run out, or the fluid level may greatly differ between the ① and ② side and the ③ and ④ side, whereby faulty application occurs. Accordingly, to prevent this, the supply is then switched to being made from ③ and ④. That is, in the event that supply from ① and ② alone and ③ and ④ alone is continued a certain number of times, two times for example, or more, the merging position moves each time, and application irregularities do not occur. Also, taking the flatness of the application fluid level into consideration, it is even more preferable that occasions for supply from both groups simultaneously, i.e., from ①, ②, ③, and ④, be periodically narrowed.

Figure 25:
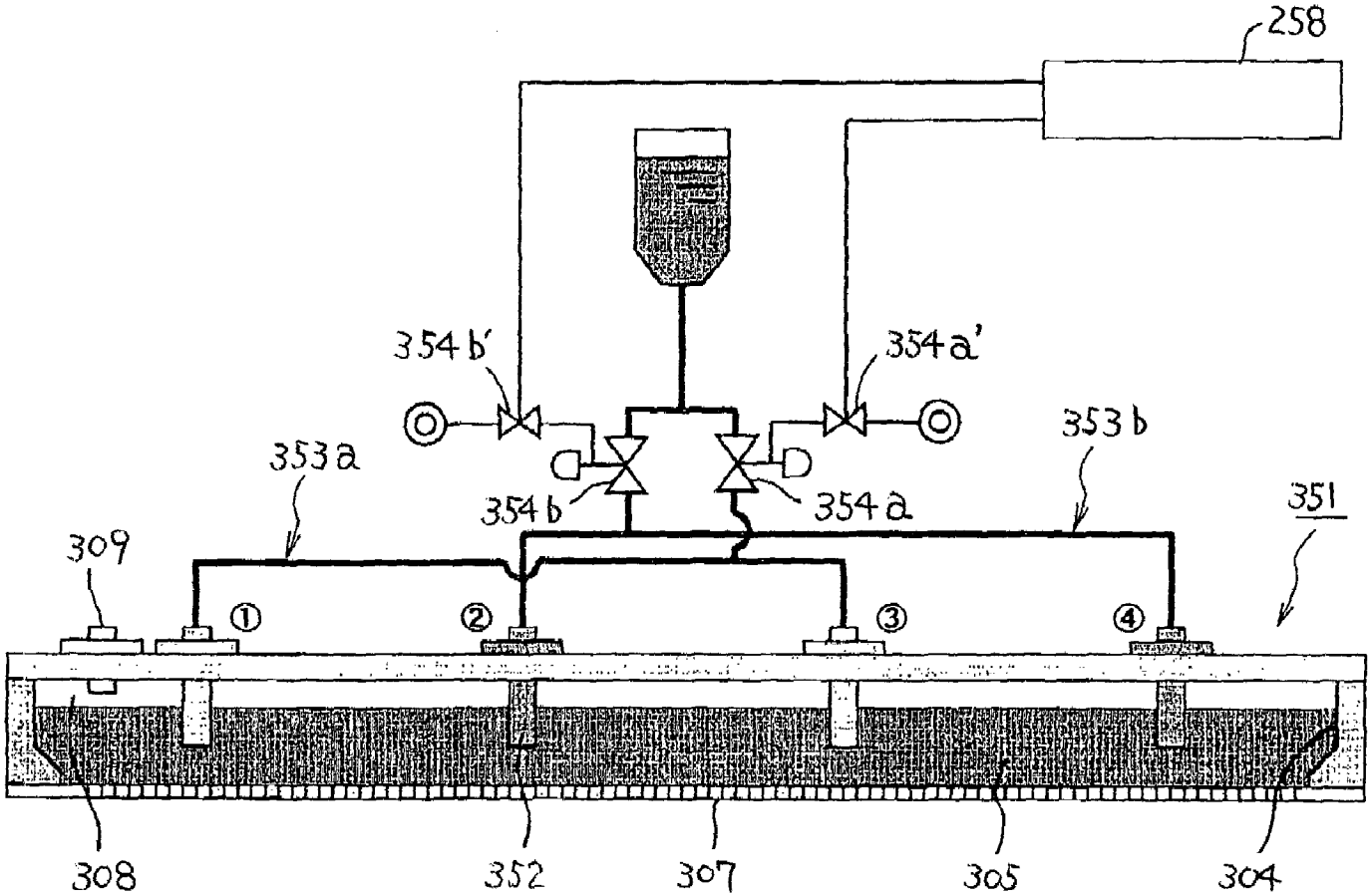
FIG. 25 is a schematic configuration diagram of the die according to yet another example of the present invention.

FIG. 25 illustrates a die 351 wherein the multiple application fluid supplying openings 352 are alternately divided into two groups (groups of ① and ③, and ② and ④), and connected with tournament-ladder-shaped channels 353*a* and 353*b*. Supply flow adjustment control valves 354*a* and 354*b* are provided to each of the two groups, and to the upstream side where these merge. These supply flow adjustment control valves 354*a* and 354*b* may be supply flow adjustment control valves of forms such as shown in FIG. 23, or may be controlled by pressurized air control valves 354*a*' and 354*b*' wherein the opening and closing of the valve is controlled by pressurized air and the pressurized air controls the opening and closing by electric signals, as shown in FIG. 25. Accordingly, four places may be supplied simultaneously, or supply may be repeated from one group alone, such as from ① and ③ alone, or ② and ④ alone. The difference with the example shown in FIG. 23 is that there is an application fluid supplying opening of one group near the merging point of the application fluid from the application fluid supplying openings of the other group.

Thus, at the point the supply is made from the application fluid supplying openings of one group, a merging point of the application fluid occurs therebetween, but in the event that switching is made to supply from the other group before application irregularities occur, the merging point which started to form earlier is perturbed, so application irregularities do not occur. Also, this example is more advantageous than the example shown in FIG. 23 regarding the flatness of the fluid level height. Particularly, positioning the application fluid supplying openings of one group at the merging position of the application fluid of the other group is effective, since the merging position can be perturbed even more.

Figure 26:
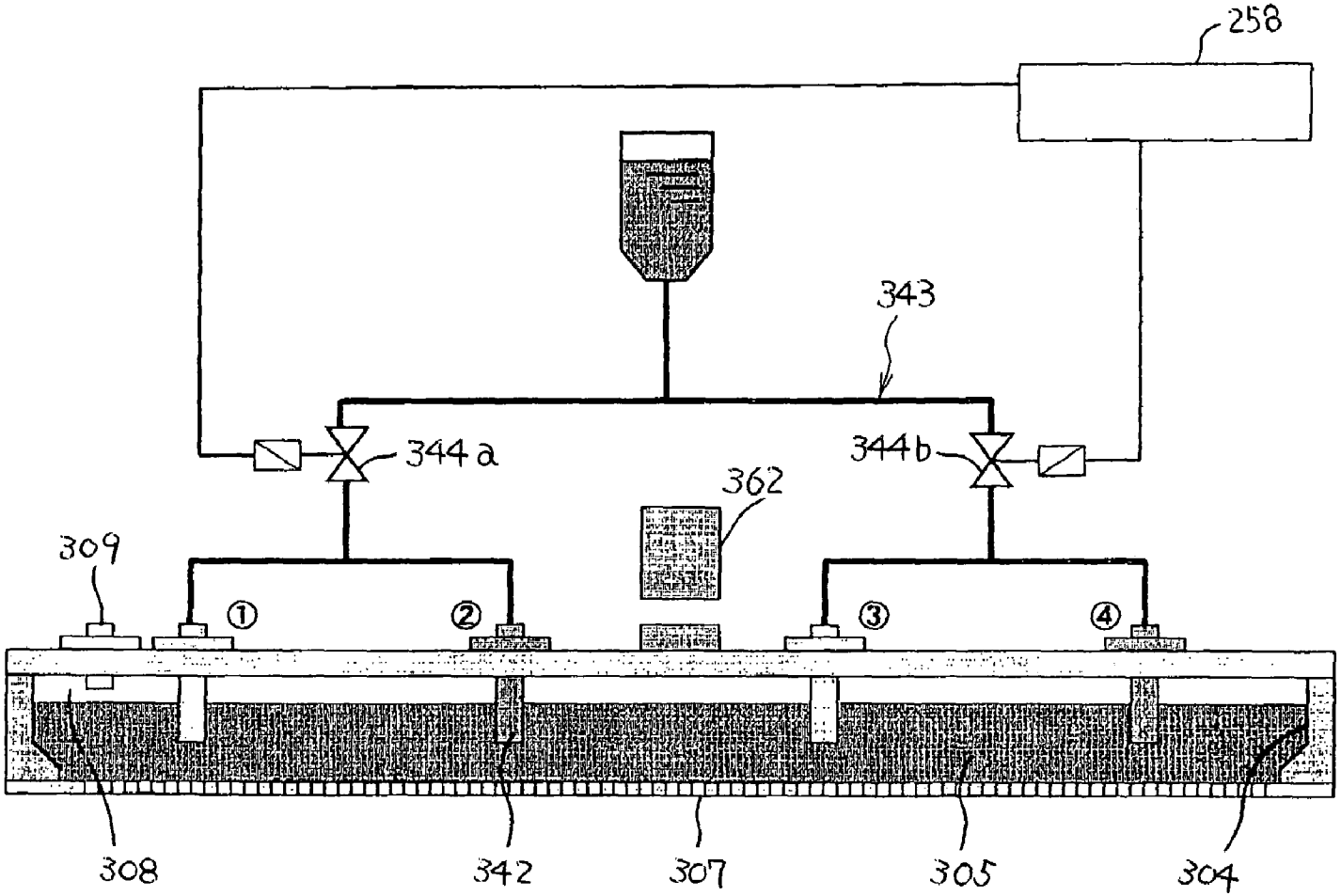
FIG. 26 is a schematic configuration diagram of the die according to yet another example of the present invention.

FIG. 26 illustrates a die 361 provided with a sensor 362 for detecting the amount of application fluid within the application fluid reservoir 304 (the fluid level with the present example). Other configurations are essentially the same as those shown in FIG. 23. The sensor 362 is electrically connected with a universal controller 60, and the universal controller 60 controls the supply device controller 58 according to the electric signals thereof. The opening and closing of the supply flow adjustment control valves 344*a* and 344*b* is controlled by the supply device controller 258, thereby supplying (replenishing) application fluid, with the application apparatus.

One method with this apparatus is to set an upper limit value and lower limit value for the amount of application fluid within the application fluid reservoir 304, and to start supplying at the point of falling below the lower limit and filling to the upper limit. While depending on the difference between the upper limit and lower limit, this method is a method wherein a relatively large amount of application fluid is supplied with one supplying action, and change can be given to the supply flow from the application fluid supplying openings over time during one supplying action with a die such as shown in FIG. 20, so the merging position does not stay at a constant position, and application irregularities do not occur.

Also, as separate method, there is a method wherein a management value for the amount of application fluid within the application fluid reservoir 304 is set, with supplying started at the point of falling below the management value, and stopping at the point of exceeding it. While depending on the amount of application to the base material (the amount of discharge from the die), this method is a method wherein application fluid is supplied into the application fluid reservoir 304 each time an application action ends, and change can be given to the supply flow from the application fluid supplying openings with each supplying action with a die such as shown in FIG. 20, so the merging position does not stay at a constant position, and application irregularities do not occur. Also, with a die such as shown in FIG. 23 or FIG. 25, in the event that supply from ① and ② alone (or ① and ③ alone)and ③ and ④ alone (or ② and ④ alone) is continued a certain number of times, two times for example, or more, and this supplying action is subsequently repeated alternately between the groups, the merging position moves each time, and application irregularities do not occur. The amount of movement increases as the number of continuous times increases, and application irregularities do not occur, but taking the flatness of the application fluid level into consideration, it is even more preferable that occasions for supply from both groups simultaneously, i.e., from ①, ②, ③, and ④, be periodically narrowed.

Also, for the sensor, there are those for detecting the fluid level height of the application fluid without contact, for example as described above, such as laser type, ultrasound type, etc., displacement gauges. Also, there is a method for measuring the weight of the die to detect the amount of application fluid within the application fluid reservoir, and a load cell capable of converting detected weight into electric signals is preferably used for the weight detecting sensor.

Further, another preferable example of the present invention will be described with reference to drawings.

In FIG. 5, on the surface of the substrate 1 shown in FIG. 1 are formed multiple vertical barrier ribs 101 extending in the application direction of the application fluid, and horizontal barrier ribs 102 extending in the direction orthogonal to the vertical barrier ribs 101. The relation between the height (H) of the vertical barrier ribs 101 and the height (Hh) of the horizontal barrier ribs 102 is H≧Hh. Also, lattice-like grooves 110 are formed on the surface of the substrate 1 by the barrier ribs 101 and 102, and the grooves 110 have recesses 104 and 103. The recesses 104 are formed as portions encompassed by the vertical barrier ribs 101 and the horizontal barrier ribs 102. On the other hand, the recess 103 is formed with of apex of the vertical barrier ribs 101 and the horizontal barrier ribs 102.

FIG. 6 illustrates around the die 18, viewing the application apparatus shown in FIG. 5 from the X-axial direction. A representative groove 110 on the substrate 1 is imaged with a camera 22 attached to the Z slide table 13, the X slide table 4 is moved with the X-axial position control unit 24 by an image position processing unit 23, and control is made such that the center of the representative recess 110 and the center of a representative discharge orifice 18*a* of the die 18 corresponding to the representative recess 110 match.

Figure 27:
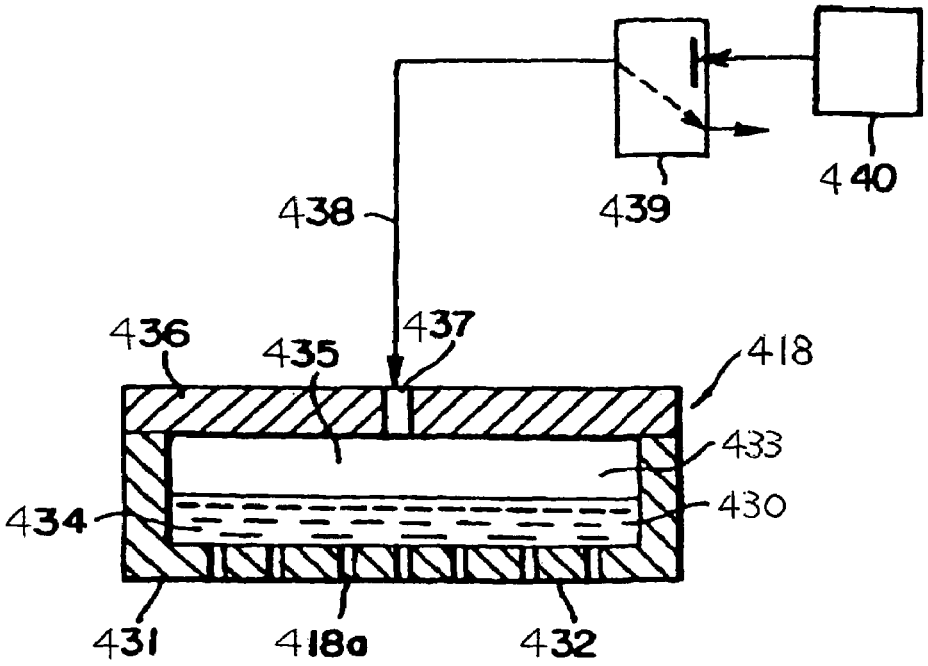
FIG. 27 is a schematic diagram of a supply control device for application fluid to the die of the apparatus shown in FIG. 5.

FIG. 27 is a schematic vertical cross-sectional view of the supply control device for application fluid to the die 18 of the application apparatus shown in FIG. 5. In FIG. 27, the die 418 comprises a casing 431, and multiple discharge orifices 418*a* for discharging application fluid are bored on the lower face plate 432 of the casing 431, in single line at predetermined intervals. The space 433 within the casing 431 is formed with an application fluid storing portion 434 where the application fluid 430 (fluorescent substance paste 427) is stored, and air space 435 situated above. A gas pressure conducting hole 437 is provided on the upper face plate 436 of the casing 431, and one end of a gas pressure conducting channel 438 is connected to the gas pressure conducting hole 437. The other end of the gas pressure conducting channel 438 is opened to a gas pressure source 440 having pressure which is maintained at a set pressure. Opening/closing means 439 formed of a direction switchover valve are provided to the gas pressure conducting channel 438, and the gas space 435 and gas pressure source 440 communicate or are cut off by opening/closing switching of the opening/closing means 439. The opening/closing means 439 detect the relative position between the discharging orifices 418*a* of the die 418 and the substrate 1, and the timing for opening and closing is controlled by position detecting and discharge controlling means not shown in the drawings, for controlling the timing of the opening/closing means 439. With the present example, for the paste 427, one color of R (red), G (green), and B (blue) is applied.

Figure 28:
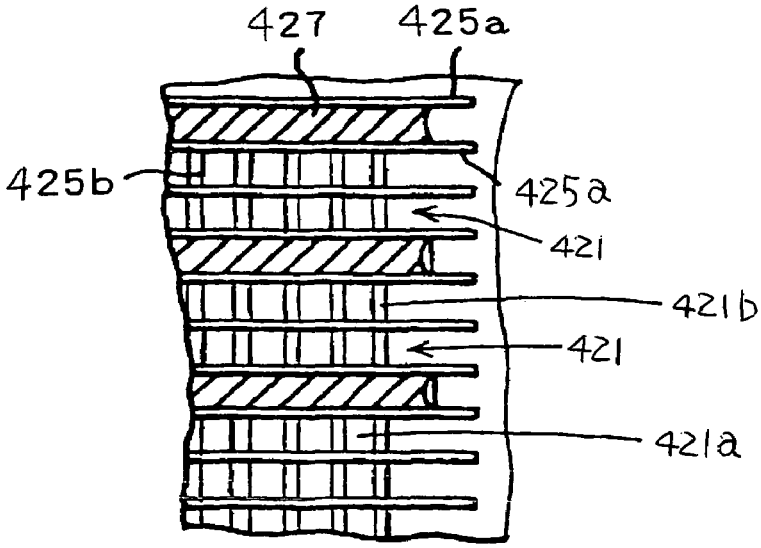
FIG. 28 is a partially enlarged plan view of a substrate with application fluid applied to the grooves.
Figure 29:
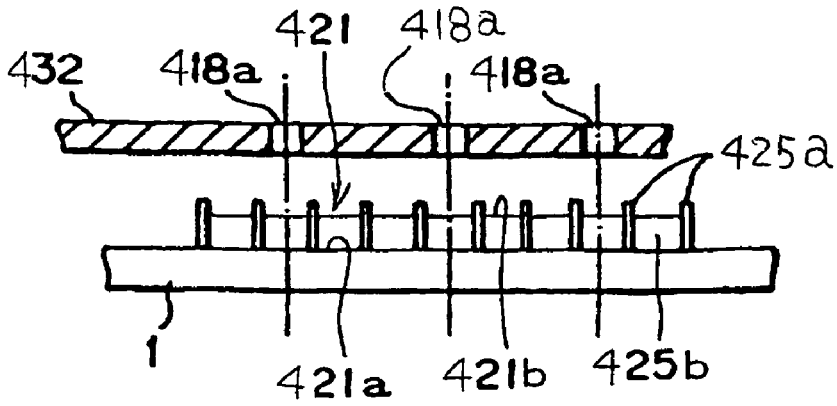
FIG. 29 is a schematic diagram illustrating the positional relation between the discharge orifices of the die and the grooves.
Figure 30:
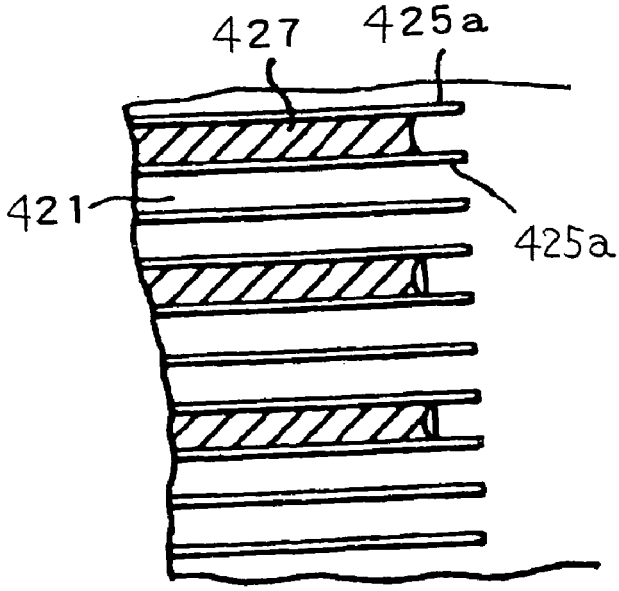
FIG. 30 is a partially enlarged plan view of the substrate.

FIG. 28 is a detailed view of the recesses 421 formed on the substrate 1 from above. With the present example, application fluid of the same color can be applied to every third recess 421, as shown in FIG. 29. Accordingly, the pitch of the discharge orifices 418*a* is three times the pitch of the vertical barrier ribs 425*a*. Note that the substrate 1 be without horizontal barrier ribs 425*b*, as shown in FIG. 30.

Figure 31:
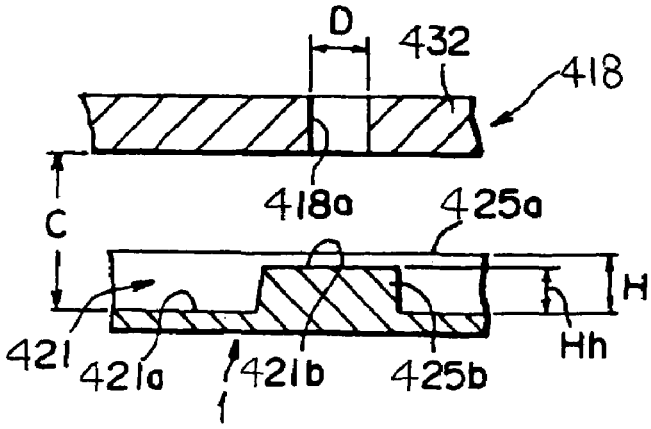
FIG. 31 is an enlarged cross-sectional diagram illustrating the positional relation between the die of the apparatus shown in FIG. 5 and the substrate.
Figure 32:
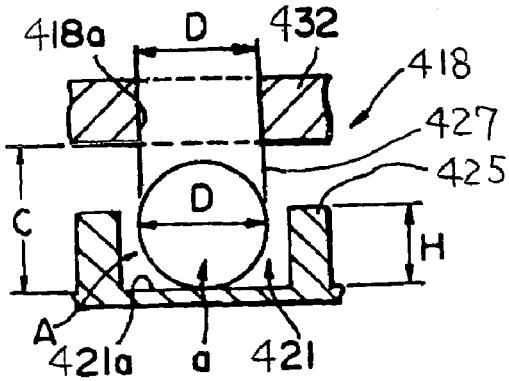
FIG. 32 is an enlarged cross-sectional diagram following line XI—XI in FIG. 33.

With the present example, the diameter (D) of the discharge orifices 418*a*, the height (Hh) of the horizontal barrier ribs 425*b*, and the spacing (C) between lower face plate 432 of the die 418 and the bottom face of the recesses 421*a* of the grooves 421 satisfy the conditions of D+Hh<C (FIG. 31). The paste 427 discharged from the discharging orifices 418*a* maintain the form of the discharging orifices 418*a* immediately after (FIG. 32). However, as long as the relation of D+Hh<C stands, even in the event that the paste 427 is applied to the apex of the horizontal barrier ribs 421*b*, this will not adhere to the lower face plate 432.

Also, in the event that the discharge orifices 418*a* have a non-circular shape, the opening dimensions (B) of the discharge orifices 418*a* following the direction of application of the application fluid satisfy the conditions of B+Hh<C.

Figure 33:
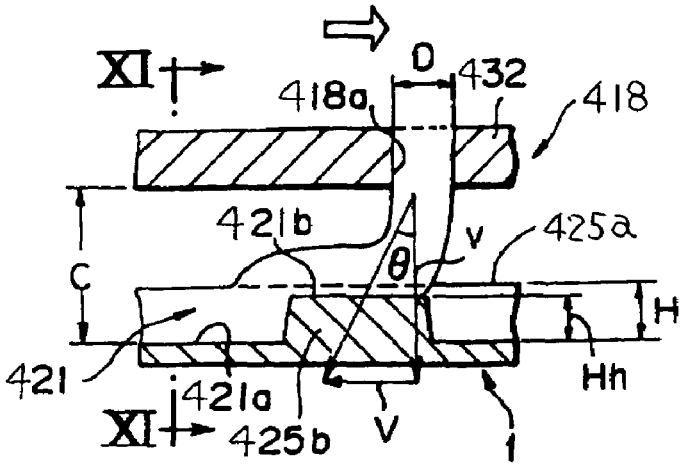
FIG. 33 is an enlarged cross-sectional diagram illustrating the application state of application fluid from the discharge orifices of the die shown in FIG. 5.

Also, with the present example, the relative motion velocity (V) between the die 418 and substrate 1, and the discharge velocity (v) of the paste 427 from the discharge orifices 418*a* must be $0<V/v\leqq 1$. As shown in FIG. 32 and FIG. 33, the paste 427 discharged from the discharging orifices 418*a* bends in the direction of relative movement between the die 418 or substrate 1. Also, in order to prevent adhesion of the discharged paste 427 to the lower face plate 432, the discharge angle (θ) consisting of the discharge velocity (v) and the movement velocity (V) of the substrate 1 or die 418 in the application direction (direction of the arrow) is preferably made as small as possible. The discharge angle (θ) may be expressed by $\tan\theta=V/v$. Experimentation has shown that adhering of the paste 427 to the lower face 109 can be prevented within the range of $0°<\theta\leqq 45°$. Accordingly, in the event that $0<V/v\leqq 1$, θ can be kept within the above-described range, so adhesion of the paste 427 to the lower face plate 423 can be prevented.

Also, in order for the paste 427 to fill the groove recesses 421*a* full, the application amount (Q) per unit time is $Q=a\cdot v=A\cdot V$, and accordingly can be expressed by $\tan\theta=V/v=a/A$. Accordingly, θ can be kept within the above-described range if $0<a/A\leqq 1$, so adhesion of the paste 427 to the lower face plate 423 can be prevented.

Figure 4:
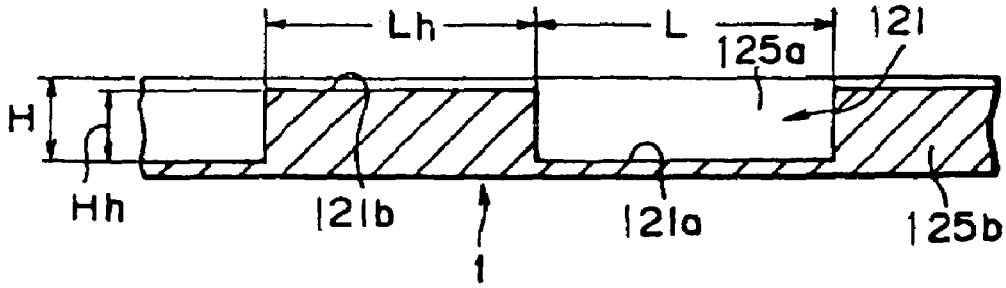
FIG. 4 is an enlarged cross-sectional diagram of the substrate.

Also, the amount of application to grooves 421 of a substrate with horizontal barrier ribs 425*b* may be less by that to a substrate without horizontal barrier ribs 425*b*, by the volume of the horizontal barrier ribs 425*b*. Paste 427 is applied uniformly to substrates with horizontal barrier ribs in the same manner as with substrates without horizontal barrier ribs, so paste 427 is stacked upon the recesses 421*b* immediately after application. However, due to letting stand for a certain amount of time (leveling), the paste 427 on the recesses 421*b* flows down into the recesses 421*a*, so the amount filling the application grooves between the horizontal barrier ribs reaches the necessary amount (full). Now, let us say that the amount of application per unit length to the grooves on a substrate with horizontal barrier ribs is Qh, and the amount of application to the grooves on a substrate without horizontal barrier ribs is Q. In FIG. 4, with the groove width as W, the Qh per unit length (Lh+L) is $$Qh=W\cdot H\cdot L+W\cdot(H-Hh)\cdot Lh.$$

Also, Q in the event that there are no horizontal barrier ribs is $$Q=W\cdot H\cdot(Lh+L).$$

Accordingly, the ratio k between the amount of application Qh to the grooves on a substrate with horizontal barrier ribs and the amount of application Q to the grooves on a substrate without horizontal barrier ribs can be expressed by k=Qh/Q $$\begin{aligned} k &= Qh/Q \\ &= [W\cdot H\cdot L+W\cdot(H-Hh)\cdot Lh]/[W\cdot H\cdot(Lh+L)] \\ &= 1-(Hh/H)\cdot(Lh/(L+Lh)). \end{aligned}$$

Also, there is the need to set the discharge angle (θ) to θ=45° in this case as well, so with the present example, the conditions of $0<a/(k\cdot A)\leqq 1$ are satisfied.

EXAMPLES

Example 1

Comparative Example 1

Paste,containing a fluorescent substance powder emitting light of blue (viscosity approximately 600 poise) was applied using a substrate having only vertical barrier ribs, with the width between the vertical barrier ribs (W)=0.24 mm and the height of the vertical barrier ribs (H)=0.12 mm, using four types of dies with the diameter (D) of the discharging orifices of the die being 0.1 mm, 0.12 mm, 0.15 mm, and 0.22 mm.

Example 2

Comparative Example 2

Paste was applied under the same conditions as Example 1 except for changing the width (W) between the vertical barrier ribs to 0.28 mm.

Example 3

Example 4

Paste was applied under the same conditions as Example 1 except for changing the width (W) between the vertical barrier ribs to 0.38 mm.

Example 5

Comparative Example 3

Paste containing a fluorescent substance powder emitting light of blue (viscosity approximately 600 poise) was applied, with the width between the vertical barrier ribs (W)=0.24 mm, the height of the vertical barrier ribs (H)=0.12 mm, the length in the application direction between horizontal barrier ribs (L)=1 mm, the height of the horizontal barrier ribs (Hh)=0.1 mm, and the length in the application direction of one horizontal barrier rib (Lh)=0.08 mm, using four types of dies with the diameter (D) of the discharging orifices of the die being 0.1 mm, 0.12 mm, 0.15 mm, and 0.22 mm.

Example 6

Comparative Example 4

Paste was applied under the same conditions as Example 5 except for changing the width (W) between the vertical barrier ribs to 0.28 mm.

Example 7

Example 8

Paste was applied under the same conditions as Example 5 except for changing the width (W) between the vertical barrier ribs to 0.38 mm.

Figure 34:
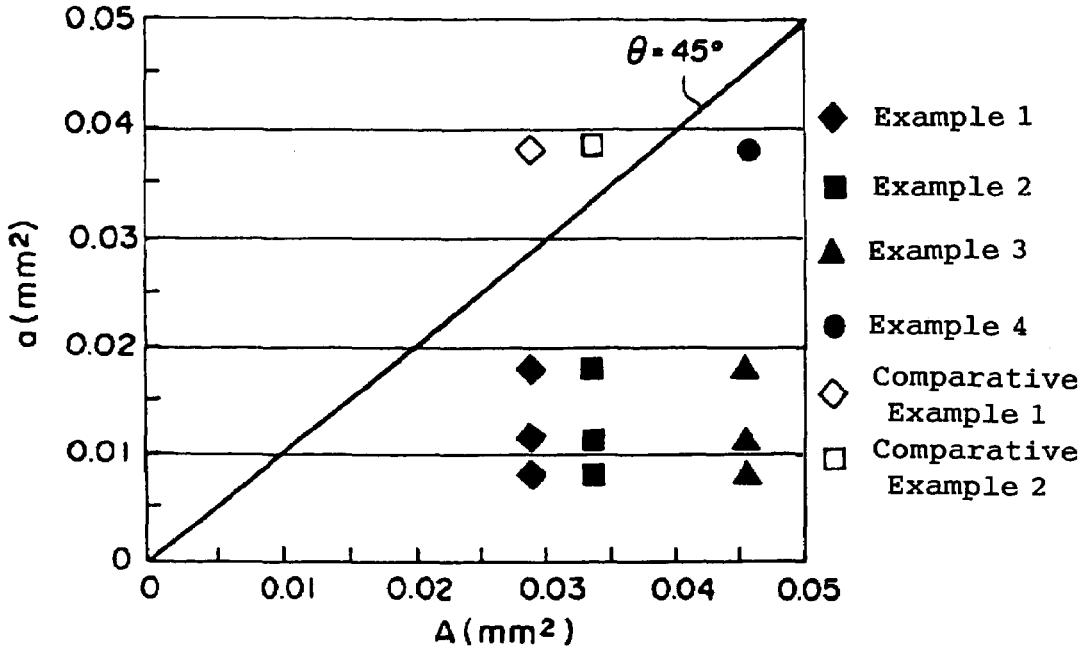
FIG. 34 is a relational diagram illustrating the relation between the discharge orifice area (a) of the die and the cross-sectional area (A) of the groove of the substrate having vertical barrier ribs on the surface thereof.
Figure 35:
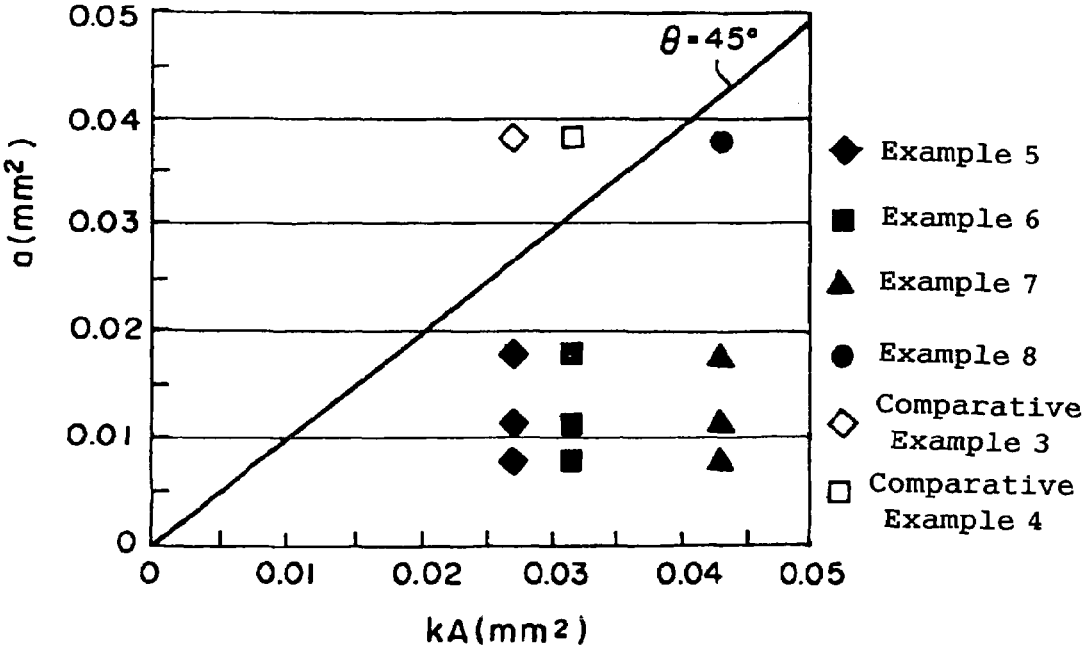
FIG. 35 is a relational diagram illustrating the relation between the discharge orifice area (a) of the die and the cross-sectional area (kA) of the groove of the substrate having vertical barrier ribs and horizontal barrier ribs on the surface thereof.

The results of the above Examples 1 through 4 and the Comparative Examples 1 and 2 are shown in Table 1 and FIG. 34. Also, the results of the above Examples 5 through 8 and the Comparative Examples 3 and 4 are shown in Table 2 and FIG. 35. As a result, with the Examples 1 through 8, there was no adhesion of paste to the lower face plate of the die, and the paste was applied to the substrate in a uniform state with no blank portions. Conversely, with the Comparative Examples 1 through 4, there was adhesion of paste to the lower face plate of the die. Also, blank portions were observed on the substrate.

Here, $a=(D/2)^2\pi$ $$A=W\cdot H$$

$$K=1-(Hh/H)\cdot(Lh/(L+Lh))$$

TABLE 1

| | W (mm) | H (mm) | D (mm) | a ($mm^2$) | A ($mm^2$) | a/A | θ (degrees) |
|---|---|---|---|---|---|---|---|
| Example 1 | 0.24 | 0.12 | 0.1 | 0.00785 | 0.0288 | 0.27271 | 15.3 |
| | 0.24 | 0.12 | 0.12 | 0.01131 | 0.0288 | 0.3927 | 21.4 |
| | 0.24 | 0.12 | 0.15 | 0.01767 | 0.0288 | 0.61359 | 31.5 |
| Comparative Example 1 | 0.24 | 0.12 | 0.22 | 0.03801 | 0.0288 | 1.31991 | 52.9 |
| Example 2 | 0.28 | 0.12 | 0.1 | 0.00785 | 0.0336 | 0.23375 | 13.2 |
| | 0.28 | 0.12 | 0.12 | 0.01131 | 0.0336 | 0.3366 | 18.6 |
| | 0.28 | 0.12 | 0.15 | 0.01767 | 0.0336 | 0.52594 | 27.7 |
| Comparative Example 2 | 0.28 | 0.12 | 0.22 | 0.03801 | 0.0336 | 1.13135 | 48.5 |
| Example 3 | 0.38 | 0.12 | 0.1 | 0.00785 | 0.0456 | 0.17224 | 9.8 |
| | 0.38 | 0.12 | 0.12 | 0.01131 | 0.0456 | 0.24802 | 13.9 |
| | 0.38 | 0.12 | 0.15 | 0.01767 | 0.0456 | 0.38753 | 21.2 |
| Example 4 | 0.38 | 0.12 | 0.22 | 0.03801 | 0.0456 | 0.83362 | 39.8 |

TABLE 2

| | W (mm) | H (mm) | L (mm) | Hh (mm) | Lh (mm) | D (mm) | a ($mm^2$) | A ($mm^2$) | k | KA | A/kA | θ (degrees) |
|---|---|---|---|---|---|---|---|---|---|---|---|---|
| Example 5 | 0.24 | 0.12 | 1 | 0.1 | 0.08 | 0.1 | 0.00785 | 0.0288 | 0.93827 | 0.02702 | 0.29065 | 16.2 |
| | 0.24 | 0.12 | 1 | 0.1 | 0.08 | 0.12 | 0.01131 | 0.0288 | 0.93827 | 0.02702 | 0.41853 | 22.7 |
| | 0.24 | 0.12 | 1 | 0.1 | 0.08 | 0.15 | 0.01767 | 0.0288 | 0.93827 | 0.02702 | 0.65396 | 33.2 |
| Comparative Example 3 | 0.24 | 0.12 | 1 | 0.1 | 0.08 | 0.22 | 0.03801 | 0.0288 | 0.93827 | 0.02702 | 1.40674 | 54.6 |
| Example 6 | 0.28 | 0.12 | 1 | 0.1 | 0.08 | 0.1 | 0.00785 | 0.0336 | 0.93827 | 0.03153 | 0.24913 | 14.0 |
| | 0.28 | 0.12 | 1 | 0.1 | 0.08 | 0.12 | 0.01131 | 0.0336 | 0.93827 | 0.03153 | 0.35874 | 19.7 |
| | 0.28 | 0.12 | 1 | 0.1 | 0.08 | 0.15 | 0.01767 | 0.0336 | 0.93827 | 0.03153 | 0.56054 | 29.3 |
| Comparative Example 4 | 0.28 | 0.12 | 1 | 0.1 | 0.08 | 0.22 | 0.03801 | 0.0336 | 0.93827 | 0.03153 | 1.20578 | 50.3 |
| Example 7 | 0.38 | 0.12 | 1 | 0.1 | 0.08 | 0.1 | 0.00785 | 0.0456 | 0.93827 | 0.04279 | 0.18357 | 10.4 |
| | 0.38 | 0.12 | 1 | 0.1 | 0.08 | 0.12 | 0.01131 | 0.0456 | 0.93827 | 0.04279 | 0.26434 | 14.8 |
| | 0.38 | 0.12 | 1 | 0.1 | 0.08 | 0.15 | 0.01767 | 0.0456 | 0.93827 | 0.04279 | 0.41303 | 22.4 |
| Example 8 | 0.38 | 0.12 | 1 | 0.1 | 0.08 | 0.22 | 0.03801 | 0.0456 | 0.93827 | 0.04279 | 0.88847 | 41.6 |

Example 9

With the die shown in FIG. 8 and FIG. 9, an application fluid reservoir forming member 985 mm in total length, 50 mm in width, 40 mm in height, with an application fluid reservoir 16 mm in width, and a discharge orifice forming member 985 mm in total length, 20 mm in width, and 1 mm in thickness, were joined by an epoxy adhesive agent, 18 braces 12 mm in diameter were arrayed in the array direction of the discharge orifices at 50 mm intervals as shown in FIG. 10, and the braces and application fluid reservoir forming member were fastened with M4 bolts. A lid member 985 mm in total length, 50 mm in width, and 10 mm in thickness was fastened by bolts, thereby assembling a die. Pressurized air of 0.8 MPa was supplied from the pressurized air supply opening, so as to boost the internal pressure of the die, and the amount of deformation of the die was measured using a dial gauge manufactured by Mitutoyo Corporation (Digimatic Indicator ID-C112). As a result, there was 0.002 mm bulging at the center portion of the die in the longitudinal direction, but there was no peeling of the discharge orifice forming member.

Comparative Example 5

Measurement was performed under the same conditions as with Example 9 except that the braces where omitted, whereby there was 0.054 mm bulging at the center portion of the die in the longitudinal direction, and there was peeling of the discharge orifice forming member.

Example 10

In FIG. 25, four application fluid supplying openings were distributed on a die 985 mm in length at 246 mm intervals, divided alternately into two groups, and each were connected with stainless-steel pipes (inner diameter 8 mm) to form a tournament-ladder-shaped channel. Paste containing a fluorescent substance powder emitting light of blue (viscosity approximately 600 poise) was then supplied to the die, alternately switching between supplying paste from the application fluid supplying openings of one group and supplying paste from the application fluid supplying openings of the other group for each occasion upon applying to the substrate, whereby no application irregularities occurred on the substrate even after 50 consecutive substrates.

Comparative Example 6

Application was made to a substrate under the same conditions as with Example 10 except that paste was continuously and simultaneously supplied from four application fluid supplying openings, whereby striped application irregularities occurred on the substrate facing the center position of the application fluid supplying openings.

INDUSTRIAL APPLICABILITY

As described above, with the die according to the present invention, pressure-resistance regarding internal pressure of the die can be improved and deformation of the die can be prevented, while suppressing increases in weight and increases in costs. Also, with the application apparatus and application method for application fluid using the die according to the present invention, application fluid can be applied while preventing deformation of the die, so application fluid can be uniformly applied on the base material.

Also, with the die according to the present invention, at the time of supplying application fluid such as fluorescent substance paste to the die, uniform supplying can be made to within the application fluid reservoir by the tournament-ladder-shaped channel, and moreover, the merging position of the application fluid supplied from each of the application fluid supplying openings can be moved, so a uniform discharge amount from the discharge orifices can be secured, air bubbles can be prevented from entering the application fluid, and faulty application can be prevented from occurring. Accordingly, application without application irregularities can be performed in a stable manner over long periods of time.

According to the application apparatus and application method for application fluid using the die according to the present invention, high productivity and high quality can be obtained for application to the base material.

Also, with the plasma display panel base material manufacturing method and plasma display according to the present invention, the above-described application apparatus and application method for application fluid is used, so plasma display panels with high quality can be manufactured in a stable manner over long periods of time, consequently enabling manufacturing with high productivity, inexpensively.

Further, with the application apparatus and application method for application fluid according to the present invention, adhesion of paste to the face where the discharge orifices of the die are formed can be prevented in a sure manner, so application fluid can be applied on the substrate in a uniform manner with no blank spots.

The invention claimed is:

1. An application apparatus for applying application fluid to a base material, comprising: a table for fixing the base material; a die, comprising an application fluid reservoir having a plurality of discharge orifices arrayed in a generally straight line for applying an application fluid to the base material, and a brace provided in the application fluid reservoir and extending in a direction generally orthogonal to the direction of the array of the discharge orifices facing the base material, for applying a predetermined amount of application fluid to the base material; and moving means for relatively moving the table and the die 3-dimensionally.

2. The application apparatus according to claim 1, wherein stripe-shaped vertical barrier ribs are formed on the surface of the base material, with the application fluid being applied in grooves between the vertical barrier ribs.

3. The application apparatus according to claim 1, wherein stripe-shaped vertical barrier ribs are formed on the surface of the base material while horizontal barrier ribs are formed in a direction generally orthogonal to the vertical barrier ribs, with the application fluid being applied in grooves between the vertical barrier ribs.

4. The application apparatus according to claim 1, wherein dimensions in the direction perpendicular to the relative movement direction of the die are longer than the application region of application fluid on the base material.

5. A manufacturing apparatus for plasma display panel base material, wherein the base material is a plasma display panel base material, and wherein the application fluid is paste containing a fluorescent substance powder for emitting light of one color of red, green, or blue, and wherein the manufacturing apparatus is comprised of the application apparatus according to claim 1.

6. A die which comprises an application fluid reservoir formed with an application fluid reservoir forming member, a discharge orifice forming member positioned at the bottom of said application fluid reservoir forming member and a lid member positioned at the top of said application fluid reservoir forming member, wherein an application fluid supplying opening is provided in said lid member, a compressed air supply opening is provided in said lid member, a plurality of discharge orifices is formed and arrayed in said discharge orifice forming member in a generally straight line for applying an application fluid to an object of application and at least one brace is provided in said application fluid reservoir and extended in a direction generally orthogonal to the direction of an array of said discharge orifices, and wherein both end portions of said brace are connected to said application fluid reservoir forming member and said brace is provided above said discharge orifice forming member to form a space between said brace and said discharge orifice forming member to facilitate supplying an application fluid into said application fluid reservoir through said application fluid supplying opening.

7. The die according to claim 6, comprising a plurality of the braces wherein the plurality of the braces further comprises at least one second brace arrayed in a direction following the array direction of the discharge orifices.

8. The die according to claim 7, wherein the plurality of the braces are disposed at equal intervals.

9. The die according to claim 6, wherein the braces are integrally formed with the application fluid reservoir forming member.

* * * * *